US010113822B1

(12) United States Patent
Hobush

(10) Patent No.: US 10,113,822 B1
(45) Date of Patent: Oct. 30, 2018

(54) EASILY CONCEALABLE HANDGUN WITH A MAGAZINE DISPLACING TRIGGER MECHANISM

(71) Applicant: Helmut W. Hobush, Orem, UT (US)

(72) Inventor: Helmut W. Hobush, Orem, UT (US)

(73) Assignee: Helmut W. Hobush, Orem, UT (US)

( * ) Notice: Subject to any disclaimer, the term of this patent is extended or adjusted under 35 U.S.C. 154(b) by 4 days.

(21) Appl. No.: 15/684,031

(22) Filed: Aug. 23, 2017

(51) Int. Cl.

| | |
|---|---|
| ***F41A 19/49*** | (2006.01) |
| ***F41A 19/13*** | (2006.01) |
| ***F41A 19/10*** | (2006.01) |
| ***F41A 3/02*** | (2006.01) |
| *F41A 9/23* | (2006.01) |

(52) U.S. Cl.
CPC ..... *F41A 19/49* (2013.01); *F41A 3/02* (2013.01); *F41A 19/10* (2013.01); *F41A 19/13* (2013.01); *F41A 9/23* (2013.01)

(58) Field of Classification Search
USPC ..... 42/6, 7, 17, 18, 11, 24, 37, 39
See application file for complete search history.

(56) References Cited

U.S. PATENT DOCUMENTS

| | | | | |
|---|---|---|---|---|
| 7,877,918 | B2 * | 2/2011 | Garavaglia | F41A 3/56 42/39.5 |
| 8,006,425 | B2 * | 8/2011 | Burt | F41A 3/66 42/1.09 |
| 8,051,594 | B2 * | 11/2011 | Carr | F41A 11/04 42/73 |
| 9,739,550 | B2 * | 8/2017 | Mochak | F41A 9/24 |

* cited by examiner

*Primary Examiner* — J. Woodrow Eldred
(74) *Attorney, Agent, or Firm* — Ryan D. Sam

(57) ABSTRACT

A handgun which vertically displaces a magazine and cocks and snaps a hammer so as to fire a bullet out of the magazine once a trigger handle has been displaced from a first position to a second position. The handgun is made up of a body, a trigger handle, a barrel, and a magazine. A magazine lift mechanism is disposed in the body and functions to vertically displace the magazine upon displacement of the trigger handle. A firing mechanism is disposed in the body, trigger handle, and barrel of the handgun and functions to fire bullets in the magazine upon displacement of the trigger handle. A trigger force mechanism is disposed in the trigger handle and provides a force against which the trigger handle is displaced. The trigger force mechanism returns the trigger handle to the first position when the trigger handle is released from the second position.

17 Claims, 21 Drawing Sheets

EASILY CONCEALABLE HANDGUN WITH A MAGAZINE DISPLACING TRIGGER MECHANISM

FIELD OF THE INVENTION

The present invention is related to handguns. More specifically, the present invention is directed to an easily concealable handgun with a trigger mechanism which actuates the vertical displacement of a bullet-chambered magazine, as well as the firing of the chambered bullets.

BACKGROUND OF THE INVENTION

Handguns have been well known in the art for hundreds of years and have made many advancements since their first introduction. Since their introduction, handguns have been used for a variety of purposes. Handguns have been used during times of war, for law enforcement purposes, for personal defense, and for recreation.

The right to keep and bear arms is recognized as a basic freedom here in the United States and is a right guaranteed by the Second Amendment to the United States Constitution. With the right to keep and to bear arms, advancements in handgun technology will be well-received. Accordingly, manufacturers of handguns have sought to develop technology advancements to exemplify a number of features in handguns which are commonly looked for by purchasers of handguns. These features include reliability, safety, concealability, and affordability.

A handgun must be reliable and safe. The user of a handgun expects the handgun to fire when needed and not to present any danger to the user when the handgun is used properly. The user expects the handgun to be durable and function without having to exert a great deal of effort in the maintenance of the handgun. Furthermore, it is desirable if the handgun embodies safety features which prevent the handgun from misfiring if dropped. Additionally, technology to prevent a curious child who may get ahold of the handgun from firing the handgun would be highly sought after.

Concealability is also a desired feature of handguns. Many handguns today are big and bulky such that they are hard to conceal when carried on the body. People having concealed carry permits desire handguns which are small and light such that they may be easily concealed on the body. A handgun with these features would be beneficial because the handgun would provide a holder of a concealed carry permit to have a handgun for personal defense purposes on their body without drawing attention from other people. Thus a handgun which is easily concealable would be well received by people who have received concealed carry permits.

Finally, affordability of a handgun may be another factor highly considered by purchasers of handguns. It is beneficial to have a simple design in a handgun such that the handgun may be easily manufactured to lower the cost of the production of the handgun. This would make a handgun more affordable to purchasers and would provide for a greater number of the public to be able to benefit from the handgun.

SUMMARY OF THE INVENTION

In one embodiment of the invention, the handgun may be comprised of a body, a trigger handle, a barrel-body, a magazine, a hood, a firing mechanism, a trigger force mechanism, a magazine lift mechanism, and a poker. Generally, the handgun is fired by displacing the trigger handle over the body from a first position to a second position. When the trigger handle is partially displaced over the body, the magazine lift mechanism aligns a bullet in the magazine with a bore of the barrel while the firing mechanism cocks a hammer. When the trigger handle is displaced to the second position, the hammer snaps forward and strikes a bullet in the magazine.

The body may have an interior and an exterior and may be comprised of two parts: a back plate and a cover. A posterior side of the body may be disposed within and may be covered by an anterior side of the trigger handle when the trigger handle is in the first position. To fire the handgun, the trigger handle is displaced from the first position to the second position, causing the trigger handle to be slid further over the exterior of the body to a fully compressed position.

The barrel may be disposed superiorly to both the body and the trigger handle and may be comprised of a magazine slot, a firing mechanism slot, a bore, and a muzzle. The magazine slot defines an opening which leads to the interior of the body and provides for the insertion of the magazine into the handgun. The bore of the barrel extends anteriorly from the magazine slot and terminates at the muzzle. The firing mechanism slot houses a portion of the hammer and allows the hammer to cock backwards and to snap forwards.

The hood may removeably attach to the barrel and encloses the firing mechanism slot so as to protect the firing mechanism. Access to the firing mechanism may be gained by removing the hood from the barrel.

The magazine may be comprised of one or more bullet chambers in which bullets may be chambered. When the trigger handle is in the first position, and before the handgun has been fired, the magazine may be disposed partially within the magazine slot and partially within the interior of the body.

The firing mechanism may be comprised of a hammer and a hammer spring. When the trigger handle is displaced from the first position, the hammer spring is stretched and the hammer is cocked backwards. When the trigger handle reaches the second position, the hammer spring relaxes and the hammer snaps forward to strike a bullet in the magazine.

The trigger force mechanism may be comprised of one or more handle springs which provide a force against which the trigger handle may be displaced. When the trigger handle is displaced, the handle springs are compressed and exert a force against the trigger handle. When the trigger handle is released, the handle springs relax and move the trigger handle back to its first position.

The magazine lift mechanism may be comprised of a lifter, a lift spring, a fulcrum cover nut, a lifter stop, a lift guide, a lift anchor and a magazine clip. The lifter may be vertically displaced by the lift spring when the trigger handle is displaced. The lift anchor keeps the lifter in place once it has been vertically displaced. The lift guide may help to guide the lift spring as it vertically displaces the lifter. The fulcrum cover nut secures the lift spring to the interior of the body and allows the lift spring to move forward and pivot upwards in order to lift the lifter. The lifter stop prevents the lifter from falling out of the magazine slot once the lifter has reached a maximum height. The magazine may be removeably attached to the magazine clip and the magazine clip may be attached to the lifter such that when the lifter is vertically displaced, the magazine clip and the magazine are also vertically displaced.

BRIEF DESCRIPTION OF THE DRAWINGS

The accompanying drawings illustrate an embodiment of the invention. In such drawings.

DETAILED DESCRIPTION OF THE PREFERRED EMBODIMENTS

Figure 1:
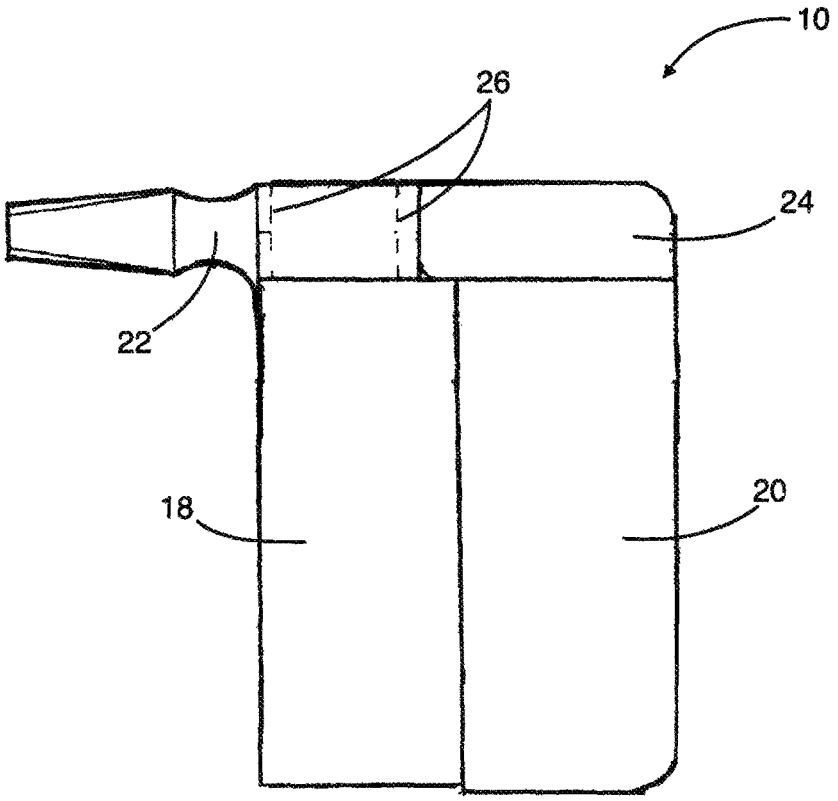
FIG. 1 illustrates a side plan view of a handgun embodying the present invention.

As shown in the drawings, an embodiment of the invention is directed to an easily concealable handgun with a trigger handle which actuates the vertical displacement of a bullet-chambered magazine, as well as the firing of the chambered bullets. The handgun 10 may be best understood as having outer-components which house a firing mechanism 12, a trigger force mechanism 14, and a magazine lift mechanism 16. The handgun 10 may be small and flat so as to fit within the palm of the user's hand. The handgun 10 may also be very light in weight. These feature of the handgun 10 allow it to be easily concealable such that it can be carried in a pant pocket, secured between a belt and the user's body, slipped down the shaft of a boot, or carried on the body at a number of other locations such that the handgun 10 is concealed. Furthermore, the handgun may be completely made of stainless steel or other durable material known in the art such that the handgun 10 is durable and consequently reliable for the user.

FIG. 1 illustrates a side plan view of the handgun 10. As can be seen from the figure, the handgun 10 may be very simple in design. The outer components of the handgun 10 include a body 18, a trigger handle 20, a barrel 22, and a hood 24. A posterior side of the body 18 may fit within an anterior side of the trigger handle 20 such that the body 18 and the trigger handle 20 form a rectangular prism shape. The barrel 22 may be attached to the top of the body 18 and a front of the barrel 22 extends out past a front side of the body 18. Just above the body 18, the barrel 22 includes a magazine slot 26 (represented by dashed lines). A magazine 28 may be placed into and removed from the handgun 10 through the magazine slot 26. The hood 24 may be removeably attachable to a posterior side of the barrel 22 and may be located above the trigger handle 20. The hood 24 may be removed from the handgun 10 to reveal a portion of the firing mechanism 12.

The handgun 10 may be fired by squeezing the body 18 and the trigger handle 20 with one's hand. Generally, upon squeezing the body 18 and trigger handle 20, the body 18 stays fixed in place while the trigger handle 20 slides from its first position further over the body 18 to a second position. While sliding over the body 18, the trigger handle 20 actuates the firing mechanism 12, the trigger force mechanism 14, and the magazine lift mechanism 16. Generally, the magazine lift mechanism 16 vertically displaces the magazine 28 such that a chambered bullet will be placed in position to be hit by a hammer 32 of the firing mechanism 12 and fired out of the barrel 22. The hammer 32 of the firing mechanism 12 snaps forward and fires the bullet when the trigger handle 20 reaches the second position. The trigger force mechanism 14 provides a force against which the trigger handle 20 may be pressed to fire the handgun 10. After the handgun 10 is fired, the trigger force mechanism 14 resets the trigger handle 20 to the first position.

Figure 2:
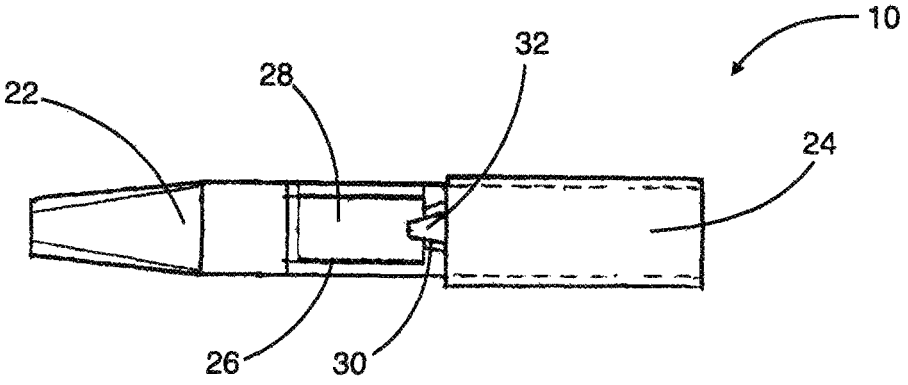
FIG. 2 illustrates a top plan view of the handgun of FIG. 1.

FIG. 2 illustrates a top plan view of the handgun 10. As can be seen in the figure, the magazine slot 26 may be disposed near the middle of the barrel 22. The magazine slot 26 may have a front wall, side walls, and a back wall. A hammer notch 30 may be located in the back wall of the magazine slot 26. When the trigger handle 20 is in the first position, the hammer 32 rests through the hammer notch 30 and into the magazine slot 26. When no shots have been fired, the hammer 32 rests on top of the magazine 28, preventing the magazine from moving vertically out of the magazine slot 26. When trigger handle 20 is displaced from the first position, the hammer 32 cocks backwards under the hood 24, allowing the magazine 28 to be vertically displaced by the magazine lift mechanism 16 such that a bullet is placed in position to be struck by the hammer 32. When the trigger handle 20 reaches the second position, the hammer 32 snaps forward striking the bullet and consequently firing the bullet out of the barrel. After a first bullet is fired, the hammer 32 rests in a first bullet chamber 80A of the magazine 28, again preventing the magazine 28 from moving vertically out of the magazine slot 26. This process is continued for the second bullet, third bullet, and so on, as will be described in more detail below.

FIGS. 3-6 illustrate top, side, front, and back plan views of the barrel 22 respectively. The barrel 22 may be generally comprised of four sections. Starting at the distal end of the barrel 22 and moving proximately, the barrel 22 may be comprised of a firing mechanism section 34, a magazine section 36, a grip section 38, and a tip section 40.

The firing mechanism section 34 generally may be comprised of a first side wall 42, a second side wall 44, and a front wall 46. The side walls 42 and 44 are separated by a firing mechanism slot 43. The firing mechanism slot 43 houses a portion of the hammer 32 and a hammer spring 158 of the firing mechanism 12, which will be discussed in more detail bellow. The firing mechanism slot 43 provides room for the hammer 32 to cock backwards and snap forwards when the handgun 10 is fired. Hammer spring pin notches 50 may be formed into or cut out of the top distal ends of the sidewalls 42 and 44. The hammer spring pin notches 50 hold a hammer spring pin 159 which secures a first end of the hammer spring 158. Hood notches 52 may be cut or formed into the distal bottom portions of the side walls 42 and 44. The hood notches 52 allow for a portion of the hood 24 to slide into the hood notches 52 and to be secured over the firing mechanism section 34. Just proximate to the hammer spring pin notches 50, hammer spring slots 54 may be formed into or cut out of the inner portion of the sidewalls 42 and 44. The hammer spring slots 54 are optional, but preferable as they make room for a hammer spring 158 that has a thicker diameter wire and consequently a greater spring force constant than otherwise could be use. A stronger hammer spring 158 allows the hammer 32 to strike a bullet with greater force when the handgun 10 is fired. If the hammer spring slots 54 were not present, a hammer spring 158 with a thinner diameter wire would have to be used so that the hammer spring 158 would not rub along the side walls 42 and 44. As previously mentioned, a hammer notch 30 is formed or cut out of the top portion of the front wall 46. The hammer notch 30 may extend into the magazine section 36 of the barrel 22. While the hammer notch 30 may be in any shape that allows the hammer 32 to pass over the front wall 46 to strike a bullet, it is preferable that the shape of the hammer notch 30 resembles the shape of a head 150 of the hammer 32 such that when the hammer 32 rests in the hammer notch 30 there is just enough excess space to allow the head 150 of the hammer 32 to move freely in and out of the hammer notch 30.

Figure 3:
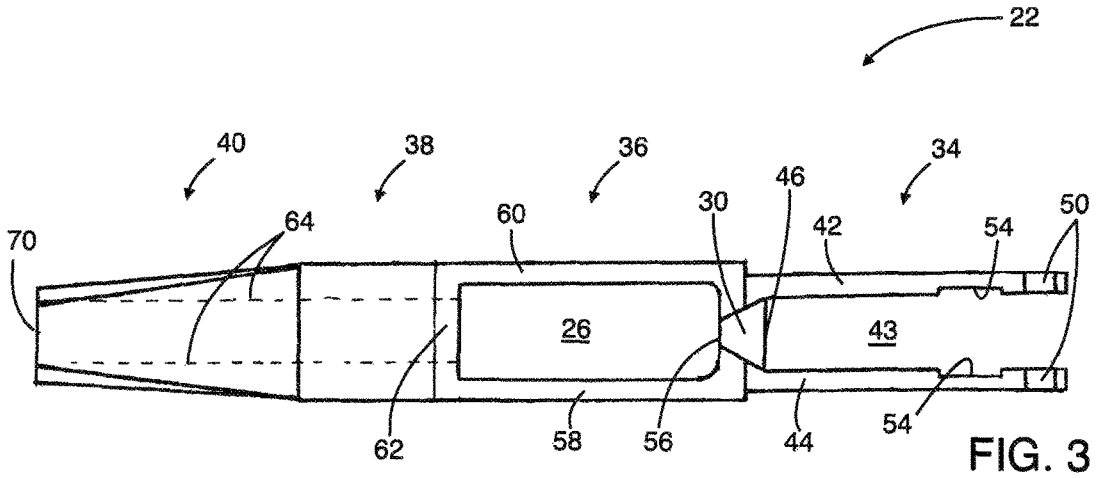
FIG. 3 illustrates a top plan view of a barrel of the handgun of FIGS. 1 and 2.
Figure 4:
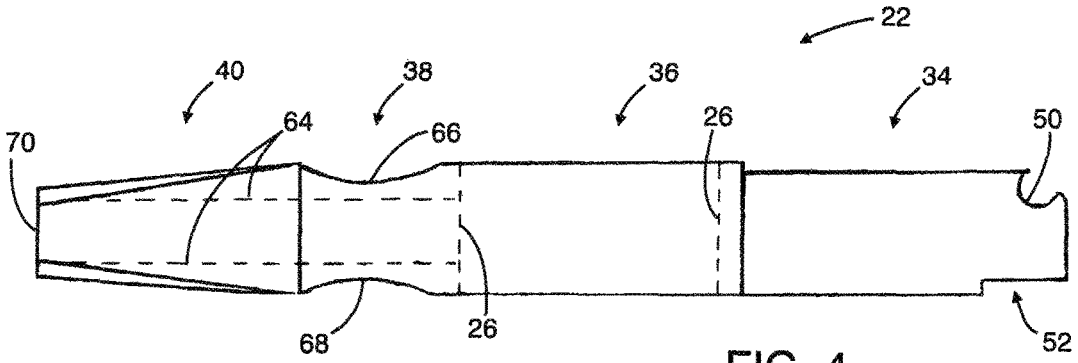
FIG. 4 illustrates a side plan view of the barrel of FIG. 3.
Figure 6:
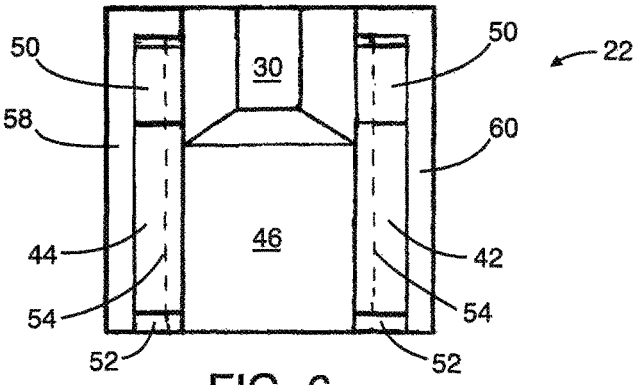
FIG. 6 illustrates a back plan view of the barrel of FIGS. 3-5.

The magazine section 36 of the barrel 22 may be generally comprised of a back wall 56, a first side wall 58, a second side wall 60, and a front wall 62. As best seen in FIG. 3, the back wall 56 may be slightly greater in length than the front wall 46 of the firing mechanism section 34. As best seen in FIG. 4, the back wall 56 may also be slightly taller than the front wall 46 and the side walls 42 and 44 of the firing mechanism section 34. This difference in length and height between the magazine section 36 and the firing mechanism section 38 allows for the hood 24 to be placed over the firing mechanism section 34 such that the hood 24 may be flush with the magazine section 36. The difference in length and height is also shown in FIG. 6 which represents a back plan view of the barrel 22.

As previously mentioned, a magazine slot 26 may be defined by the walls of the magazine section 36. The magazine slot 26 allows for the magazine 28 of the handgun 10 to be placed into or removed from the handgun 10. The hammer notch 30 extends through the back wall 56 of the magazine section 36, allowing the hammer 32 to strike the bullets in the magazine 28. A bore 64 (defined by the dashed lines in FIGS. 3 and 4) extends through the tip section 40, the grip section 38, and the front wall 62 of the magazine section 36, extending anteriorly from the magazine slot 26 to a muzzle 70.

Besides defining a portion of the bore 64, the grip section 38 comprises an upper curved groove 66 and a lower curved groove 68. When holding the handgun 10, the index finger may rest in the lower curved groove 23, allowing the handgun 10 to be more ergonomic to hold. The upper and lower curved grooves 66 and 68 together also allow the handgun 10 to be secured by a belt loop, a portion of a holster, etc.

Figure 5:
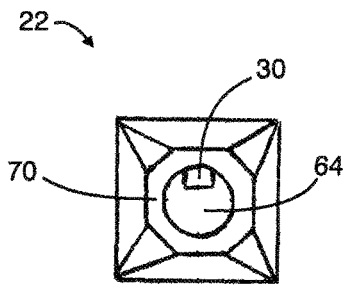
FIG. 5 illustrates a front plan view of the barrel of FIGS. 2 and 3.

As described above, the tip section 40 also defines a portion of the bore 64. A muzzle 70 of the bore 64 may be located at the proximal end of the tip section 40, allowing the fired bullets to exit the handgun 10. The tip section 40 may be a number of different shapes, but preferably is wider at the distal end and narrows to the proximate end. The tip section 40, may be a cone-like shape, but preferably is comprised of four trapezoidal planes and four triangular planes that fit together such that the distal portion of the tip section 40 is in the shape of a square, while the proximal portion of the tip section 40 is in the shape of an octagon. This structure of the tip section 40 is best seen in FIG. 5.

Figure 7:
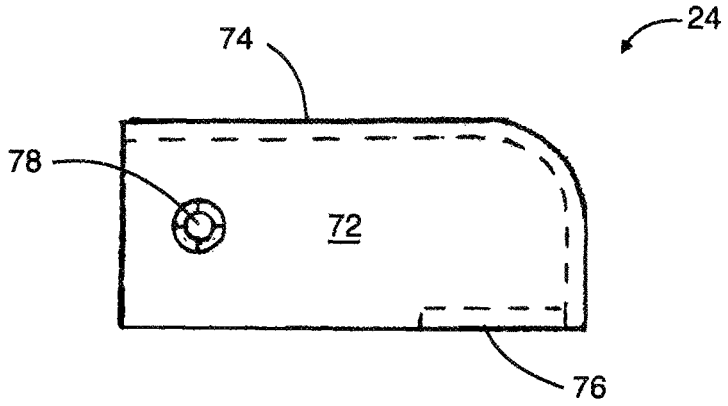
FIG. 7 illustrates a side plan view of a hood of the handgun of FIGS. 1 and 2.
Figure 8:
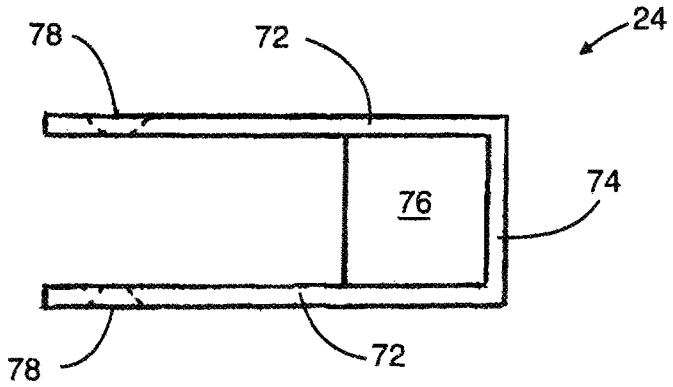
FIG. 8 illustrates a bottom plan view of the hood of FIG. 7.
Figure 9:
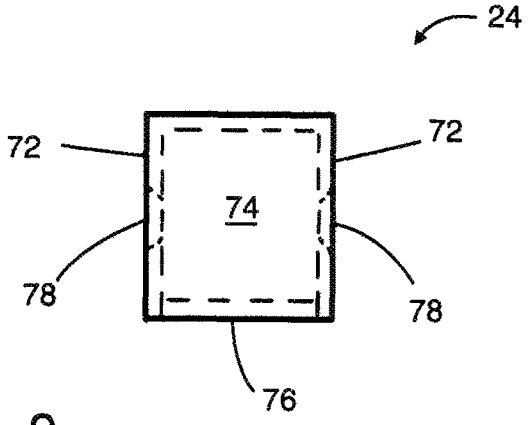
FIG. 9 illustrates a back plan view of the hood of FIGS. 7 and 8.

FIGS. 7-9 illustrate a side, bottom, and back plan view respectively of the hood 24 of the handgun 10. The hood 24 may be comprised of side walls 72, a curved top wall 74, and a bottom wall 76. The curved top wall 74 and the bottom wall 76 keep the sidewalls 72 separated from each other, and together, the sidewalls 72, the curved top wall 74, and the bottom wall form a cover which slides over the firing mechanism section 34 of the barrel 22. The bottom wall 76 may only be about a third of the length of the hood 24, consequently, when the hood 24 is placed over the firing mechanism section 34, the bottom wall 76 of the hood 24 slides into and may be secured by the hood notches 52 of the barrel 22. One or more screw apertures 78 are disposed within the sidewalls 72. Preferably, one screw aperture 78 is disposed within each sidewall 72. The screw apertures 78 allow screws to further secure the hood 24 to the barrel 22.

Figure 10:
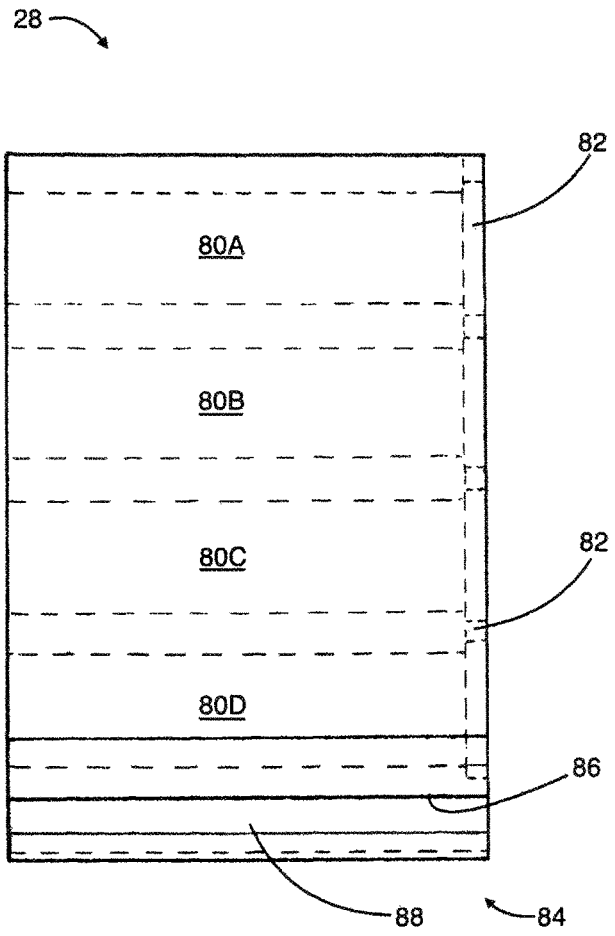
FIG. 10 illustrates a side plan view of a magazine of the handgun of FIGS. 1 and 2.
Figure 11:
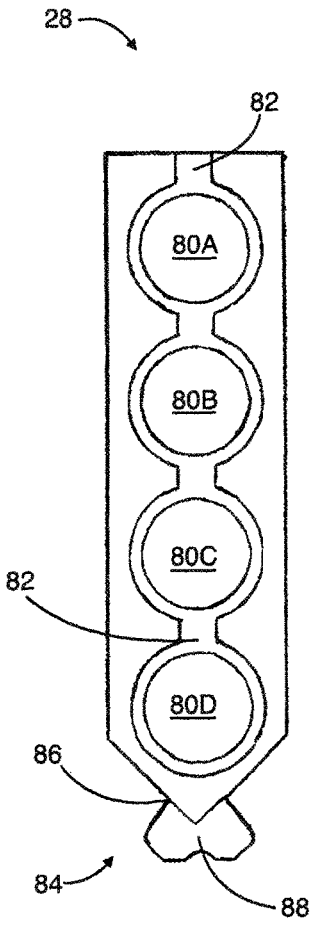
FIG. 11 illustrates a back plan view of the magazine of FIG. 10.

FIGS. 10 and 11 illustrate a side and a front plan view respectively of the magazine 28. The magazine 28 may generally be comprised of one or more bullet chambers 80, a bullet catch indentation 82, and a clip structure 84. The magazine 28 may generally be a rectangular prism in shape with the clip structure 84 at the inferior portion of the rectangular prism. Referring specifically to FIG. 11, which illustrates the back plane of the magazine 28, the clip structure 84 starts with a narrowing width in relation to the width of the main rectangular prism of the magazine 28. The width of the clip structure 84 narrows until a waist 86 is reached. The width of the clip structure 84 then increases to form a clip body 88. With reference back to the side plane of the magazine 28, FIG. 10 illustrates that the clip body 88 may extend the entire width of the side plane of the magazine 28. The clip structure 84, clips into a magazine clip 276 which will be described in more detail bellow when the magazine lift mechanism 16 is described.

With reference again to both FIGS. 10 and 11, the magazine 28 preferably comprises four bullet chambers 80A-D, but in alternative embodiments, the magazine 28 may have one bullet chamber 80 or a plurality of bullet chambers 80. The bullet chambers 80 may be separated from each other and vertically stacked along the center of the magazine 28 with respect to the width of the posterior plane. With reference now to FIG. 11, the bullet catch indentation 82 may be formed into the posterior plane of the magazine 28 around the bullet chambers 80. The bullet catch indentation 82 may function to catch the rim of a bullet shell such that when a bullet is inserted into one of the bullet chambers 80, the rim of the bullet shell catches in the bullet catch indentation 82. This prevents the bullets from being pushed too far into the magazine 28 and allows the hammer 32 to strike and fire the bullets when the trigger handle 20 is displaced to the second position. Furthermore, when a bullet is fired, the bullet shell remains in its chamber 80 and may later be removed by the aid of the poker 348 which is described in more detail bellow.

The bullet chambers 80 and bullet catch indentation 82 are preferably sized to chamber twenty-two caliber long bullets, but in alternative embodiments, the bullet chambers 80 and the bullet catch indentation 82 may be sized to chamber any caliber bullet as commonly used and known in the art. For example, instead of being sized to chamber twenty-two caliber long bullets, the bullet chambers could be sized to fit nine millimeter caliber bullets.

Figure 13:
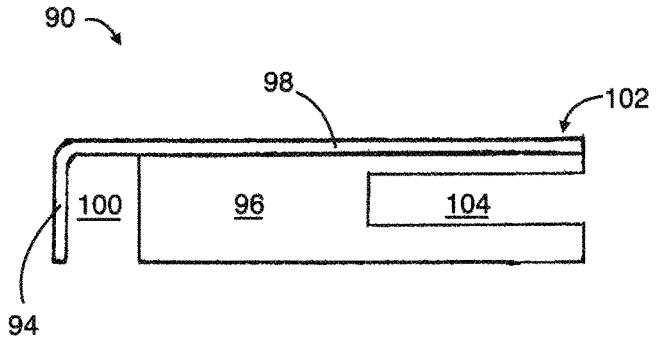
FIG. 13 illustrates a top plan view of the back plate of the body of FIG. 12.
Figure 12:
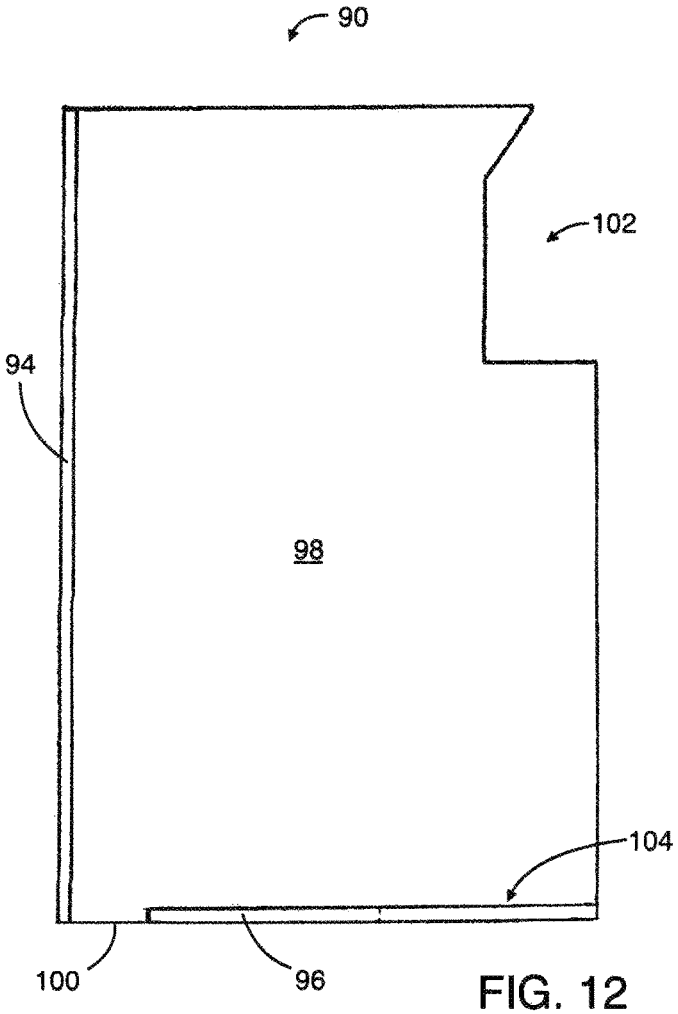
FIG. 12 illustrates a side plan view of a back plate of a body of the handgun of FIGS. 1 and 2.
Figure 14:
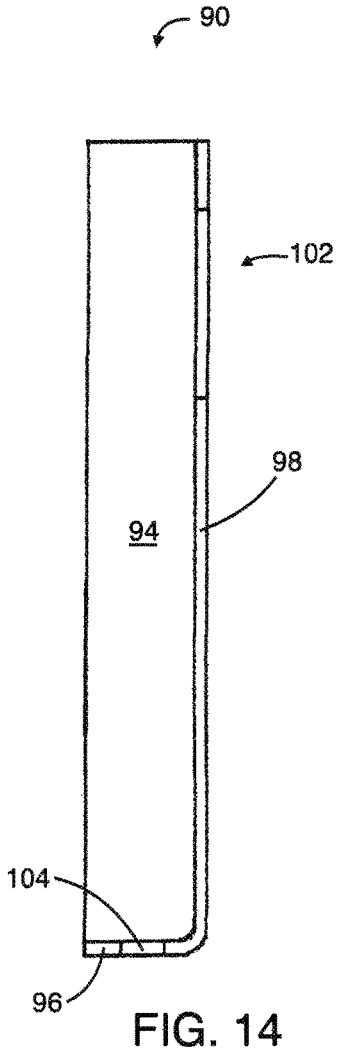
FIG. 14 illustrates a back plan view of the back plate of the body of FIGS. 12 and 13.

FIG. 12-14 illustrate side, top, and back plan views respectively of a back plate 90 of the body 18. The body 18 may be made up of two parts, the back plate 90 and the cover 92 (shown in FIG. 15). The back plate 90 may be generally comprised of three walls: the front wall 94, the bottom wall 96, and the side wall 98. Preferably, the back plate 90 is a solid component with the front wall 94 and the bottom wall 96 formed by bending or molding the front wall 94 and the bottom wall 96 to form ninety-degree angles with respect to the side wall 98. A poker notch 100 may be formed in the back plate 90 so that the front wall 94 and the bottom wall 96 are partially separated from each other. As best shown in FIG. 13, it is preferable that the poker notch 100 extends to the side wall 98 so that the front wall 94 and the bottom wall 96 are completely separated from each other. The poker notch 100 may be designed to allow a poker 348 (described in more detail below) to slide into and to be stored in the body 18.

A firing mechanism cut 102 may be located in the upper back corner of the side wall 98 of the back plate 90. While the firing mechanism cut 102 is optional, it is preferable as it allows a hammer spring 158 of the firing mechanism 12 to have a greater spring force constant. The firing mechanism cut 102 allows for a spring with a larger diameter wire to be used as the hammer spring 158, thereby allowing the hammer spring 158 to have a greater spring force constant. If the firing mechanism cut 102 was not used, then a spring with a smaller diameter wire, and consequently a smaller spring force constant, would have to be used for the hammer spring 158 to prevent the hammer spring 158 from rubbing along the side wall 98. The firing mechanism cut 102 may be a variety of different shapes so long as the firing mechanism cut 102 allows the hammer spring 158 to extend and relax without coming into contact with the side wall 98. For example, the firing mechanism cut 102 may be composed of smaller straight cuts at crisp angles in relation to each other as shown in the drawings. Alternatively, the firing mechanism cut 102 may be a curved cut. One skilled in the art would recognize that the important feature of the firing mechanism cut 102 is that it keeps the hammer spring 158 from contacting the side wall 98 of the back plate 90.

A trigger handle notch 104 may be located in the bottom wall 96 of the back plate 90. The trigger handle notch 104 may be approximately a third of the width of the bottom wall 96. As best seen in FIGS. 13 and 14, the trigger handle notch 104 may extend along approximately half of the length of the bottom wall 96 and centrally with respect to the width of the bottom wall 96. The trigger handle notch 104 allows the trigger handle 20 to slide more smoothly over the body 18 when the trigger handle 20 is displaced from the first position or released when firing the handgun 10 as will be described in more detail below.

Figure 15:
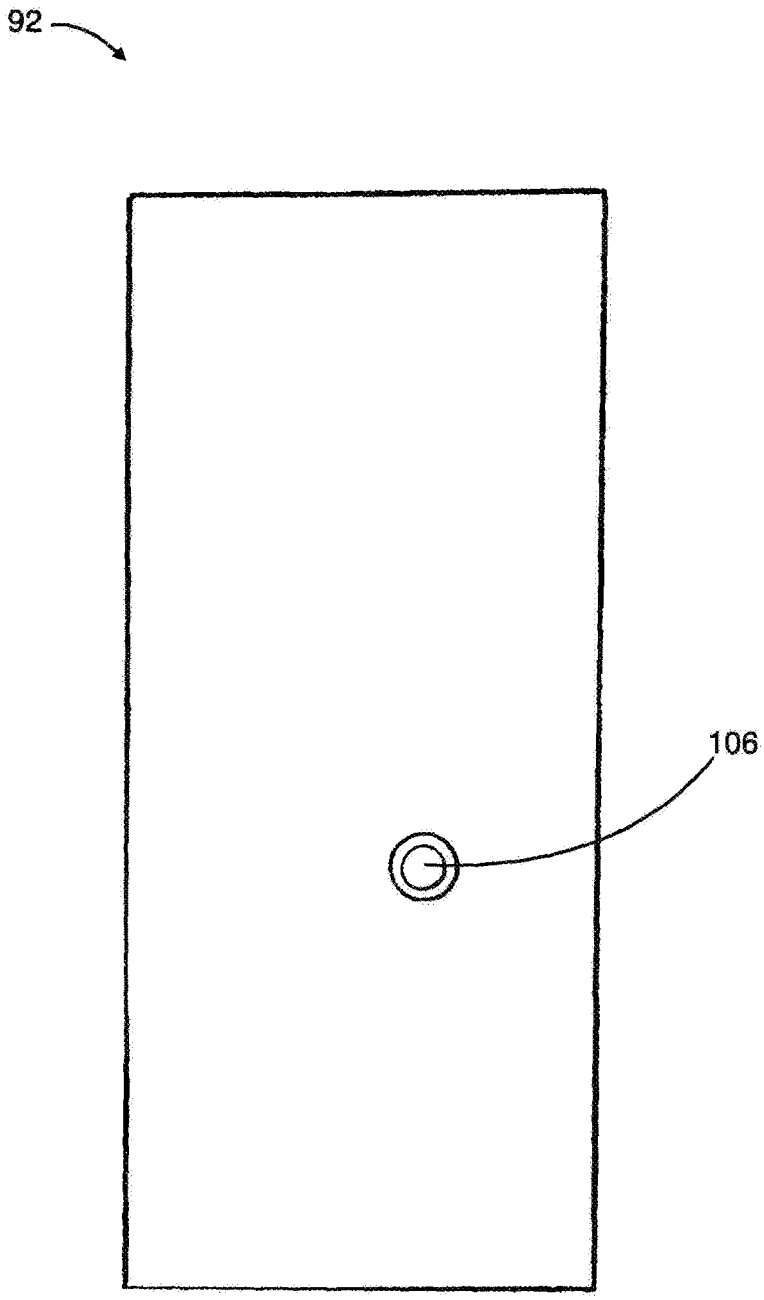
FIG. 15 illustrates a side plan view of a cover of the body of the body of the handgun of FIGS. 1 and 2.

FIG. 15 illustrates a side plan view of the cover 92. As mentioned above, the cover 92 is the second portion that makes up the body 18 of the handgun. The cover 92 may be flat and rectangular in shape. The cover 92 functions to enclose and protect all of the inner components of the body 18, which will be discussed further below. The cover 92 may have a cover aperture 106 disposed in the cover 92 such that the cover aperture 106 is aligned with a fulcrum nut 108 (seen in FIGS. 16-18) of the back plate 90. A screw may be inserted through the cover aperture 106 and may threadedly attach to the fulcrum cover nut 108 so as to secure the cover 92 to the back plate 90.

Figure 17:
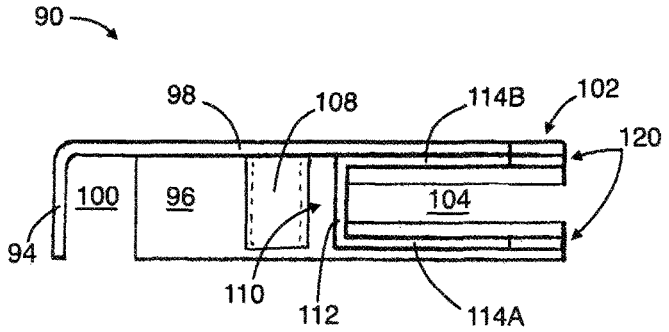
FIG. 17 illustrates a top plan view of the back plate of FIGS. 12-14 with the hammer base and the fulcrum nut of FIG. 16.
Figure 16:
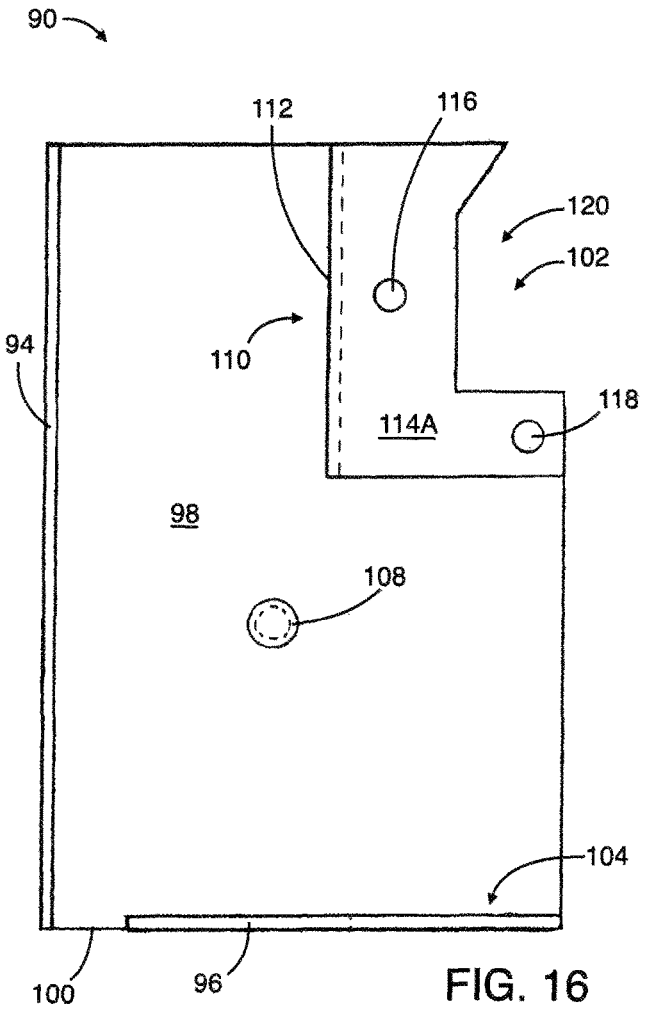
FIG. 16 illustrates a side plan view of the back plate of FIGS. 12-14 with a hammer base and a fulcrum nut.
Figure 18:
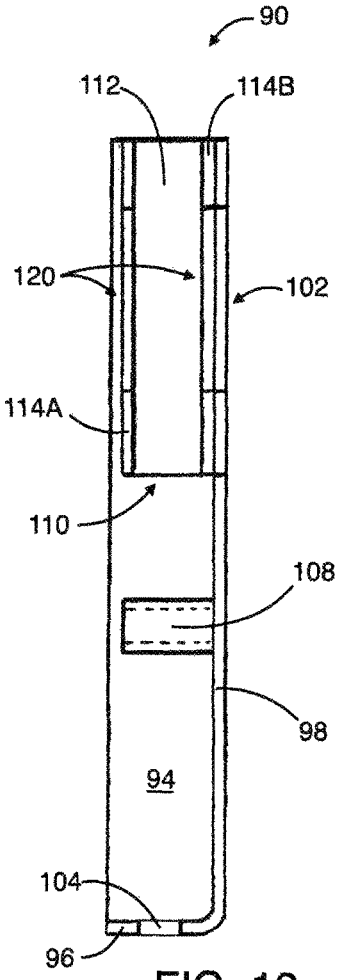
FIG. 18 illustrates a back plan view of the back plate of FIGS. 12-14 with the hammer base and the fulcrum nut of FIGS. 16 and 17.

FIGS. 16-18 illustrate a side, top, and back plan views respectively of the back plate 90 with the addition of a fulcrum nut 108 and a hammer base 110. The fulcrum nut 108 may be attached to the side wall 98 of the back plate 90 by weld, glue, or other form of attachment known in the art. Alternatively, the fulcrum nut 108 may be formed as one piece with the back plate 90 by mold. The fulcrum nut 108 is preferably cylindrical in shape with a threaded interior and a smooth exterior. As described above, a threaded screw or bolt may fit through the cover aperture 106 in the cover 90 and may threadedly attach to the fulcrum nut 108 so as to secure the cover to the back plate 90. Furthermore, the smooth exterior of the fulcrum nut 108 helps to facilitate the pivoting of a lift spring 270 (shown in FIG. 48), which will be described in more detail below in relation to magazine lift mechanism 16.

The hammer base 110 may have three walls, the front wall 112 and the side walls 114. The side walls 114 of the hammer base 110 may each have two apertures: a hammer aperture 116 and a hammer lever aperture 118. The side walls 114 may have firing mechanism cuts 120, which are preferably identical to the firing mechanism cut 102 of the back plate 90. The fire mechanism cuts 120 of the hammer base 110 may serve the same function as the firing mechanism cut 102 of the back plate 90 as described above. The hammer base 110 may be secured by weld, glue, etc. to the upper back corner of the back plate 90 such that the firing mechanism cuts 120 of the hammer base 110 and the firing mechanism cut 102 of the back plate 90 are in line with each other. Alternatively, the hammer base 110 may be molded with the back plate 90 so as to be one piece with the back plate 90. The hammer base 110 preferably extends from the back side of the body 18 to just under half of the width of the back plate 90.

Figure 19:
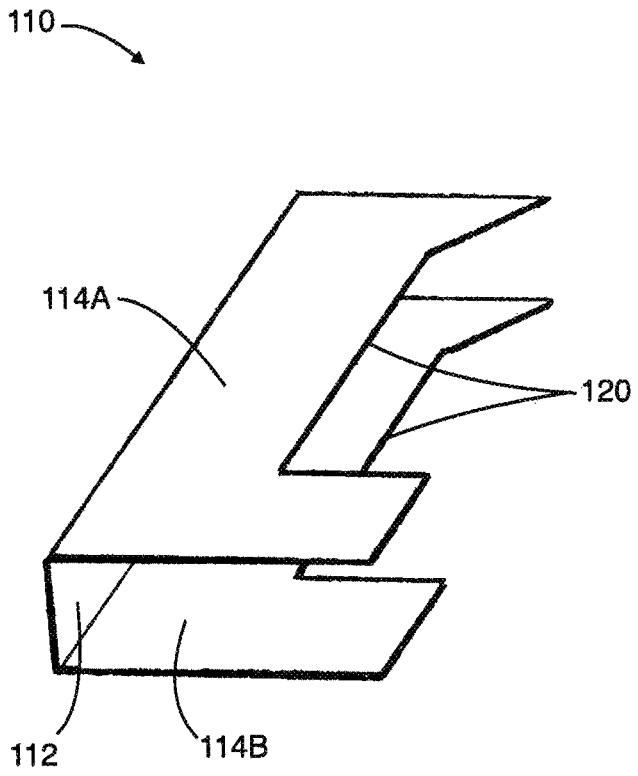
FIG. 19 illustrates a perspective view of the hammer base of FIGS. 16-18.

FIG. 19 illustrates a perspective view of the hammer base 110. The hammer base 110 may function to secure and protect the different components of the firing mechanism 12. These different components of the firing mechanism 12 and how they are secured to the hammer base 110 will be described in more detail below in relation to the firing mechanism 12.

Figure 20:
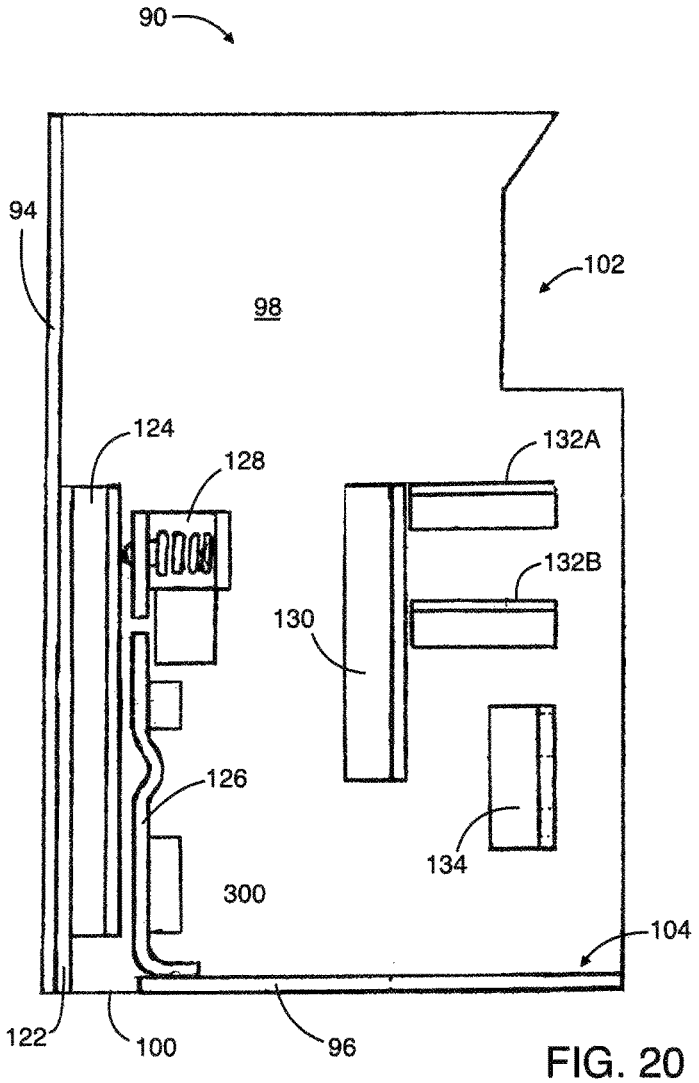
FIG. 20 illustrates a side plan view of the back plate of FIGS. 12-14 with a cover rest, a lifter stop, a lift guide, a lift anchor, a spring base, spring separators, and a rod guide.
Figure 21:
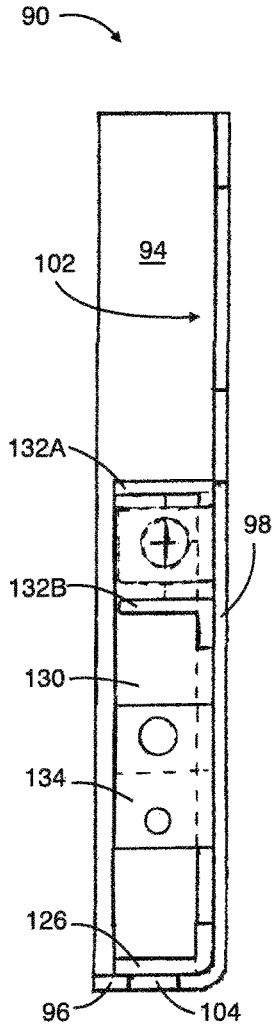
FIG. 21 illustrates a back plan view of the back plate of FIGS. 12-14 with the cover rest, lifter stop, lift guide, lift anchor, spring base, spring separators, and rod guide of FIG. 20.

FIGS. 20 and 21 illustrate a side and a back plan view respectively of the back plate 90 with the addition of a cover rest 122, a lifter stop 124, a lift spring guide 126, a lift anchor 128, a handle spring base 130, handle spring separators 132, and a rod guide 134. The lifter stop 124, lift spring guide 126, and lift anchor 128 will be discussed in further detail below in relation to the magazine lift mechanism 16. The handle spring base 130, handle spring separators 132, and the rode guide 134 will also be discussed in further detail below in relation to the trigger force mechanism 14. Generally, the cover rest 122, lifter stop 124, lift spring guide 126, and lift anchor 128 are disposed in the lower front quarter of the back plate 90 and the handle spring base 130, handle spring separators 132, and the rod guide 134 are disposed in the lower back quarter of the back plate 90 as illustrated.

Figure 22:
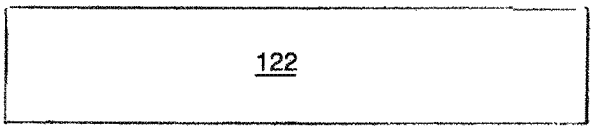
FIG. 22 illustrates a back plan view of the cover rest of FIGS. 20 and 21.

FIG. 22 illustrates a back plan view of the cover rest 122. As can be seen from the figure, the cover rest 122 may be a flat bar. With reference again to FIGS. 21 and 22, the cover rest 122 may preferably be secured by weld, glue, or any other method known in the art, to the front wall 94 of the back plate 90. The width of the cover rest 122 may be smaller than the width of the side wall 94 of the back plate 90. This difference in width allows the cover 92 to be supported by the cover rest 122 when it is secured to the back plate 90 as described above. The difference in width also allows the cover 92 to be flush with the front wall 94 and the back wall 96 of the back plate 90. In addition to the cover rest 122 supporting the cover 92, the portion of the front wall 94 making up the difference in width between the front wall 94 and the cover rest 122 may be curved slightly such that when the cover 92 is in position and resting on the cover rest 122, the front wall 94 will bend over the edge of the cover 92, further securing the cover 92 to the back plate 90.

Figure 23:
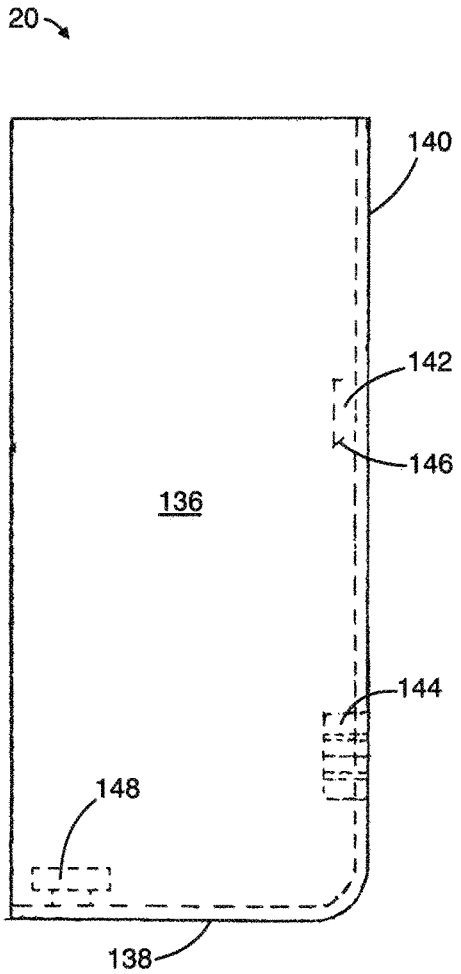
FIG. 23 illustrates a side plan view of a trigger handle of the handgun of FIGS. 1 and 2.
Figure 24:
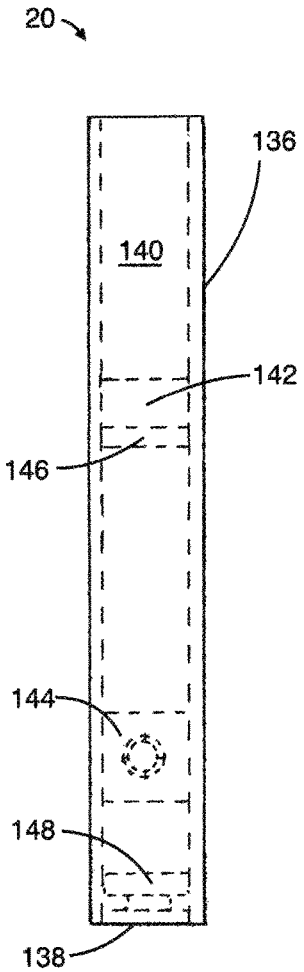
FIG. 24 illustrates a back plan view of the trigger handle of FIG. 23.

FIGS. 23 and 24 illustrate side and back plan views respectively of the trigger handle 20. Generally, the trigger handle 20 may be comprised of side walls 136, a bottom wall 138, and a back wall 140. The side walls 136 are generally orthogonal to the bottom wall 138 and the back wall 140. Together, the walls 136, 138, 140 of the trigger handle 20 define an inner space, which allows the trigger handle 20 to slide over the body 18 of the handgun 10. By displacing the trigger handle 20 over the body 18, the firing mechanism 12, the trigger force mechanism 14, and the magazine lift mechanism 16 are actuated. A rod base stop 142 and a rod base nut 144 may be disposed on the back wall 140. The rod base nut 144 has a place of attachment to the back wall 140 generally inferior to the place of attachment of the rod base stop 142. Both the rod base stop 142 and the rod base nut 144 help to secure a rod base 224 to the back wall 140 of the trigger handle 20 which will be described in more detail below in relation to the trigger force mechanism 14. The rod base stop 142 may be a small rectangular prism in shape with an angled cut 146 cut out of the bottom portion such that a portion of the rod base 224 may be slid into the angled cut 146. The rod base nut 144 may be a cuboidal prism in shape with a threaded aperture in the center so that the rod base 224 may be secured to the back wall by a threaded screw or bolt.

Figure 28:
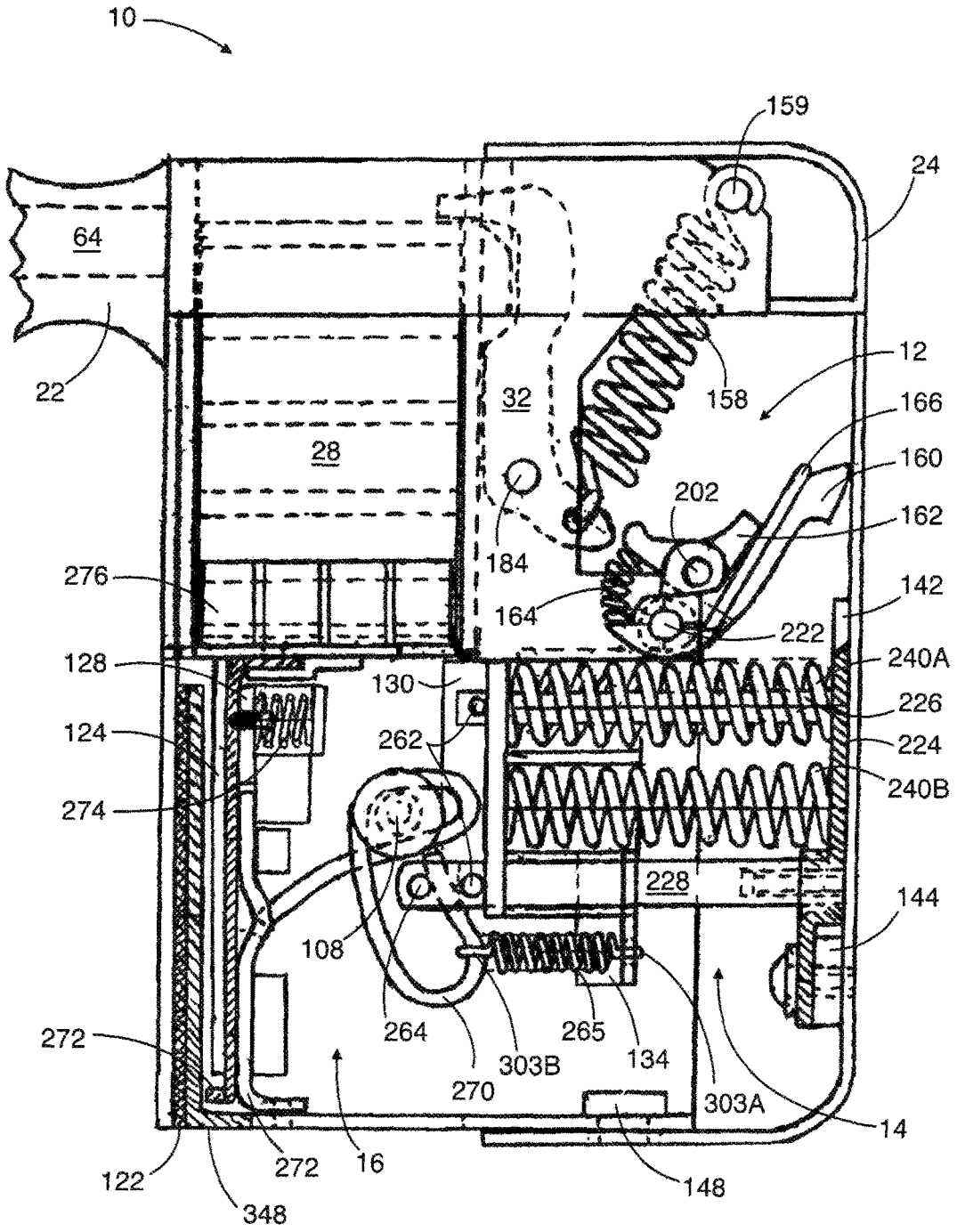
FIG. 28 illustrates a partial cut away side plan view of the handgun of FIGS. 1 and 2 with the trigger handle in the first position.
Figure 29:
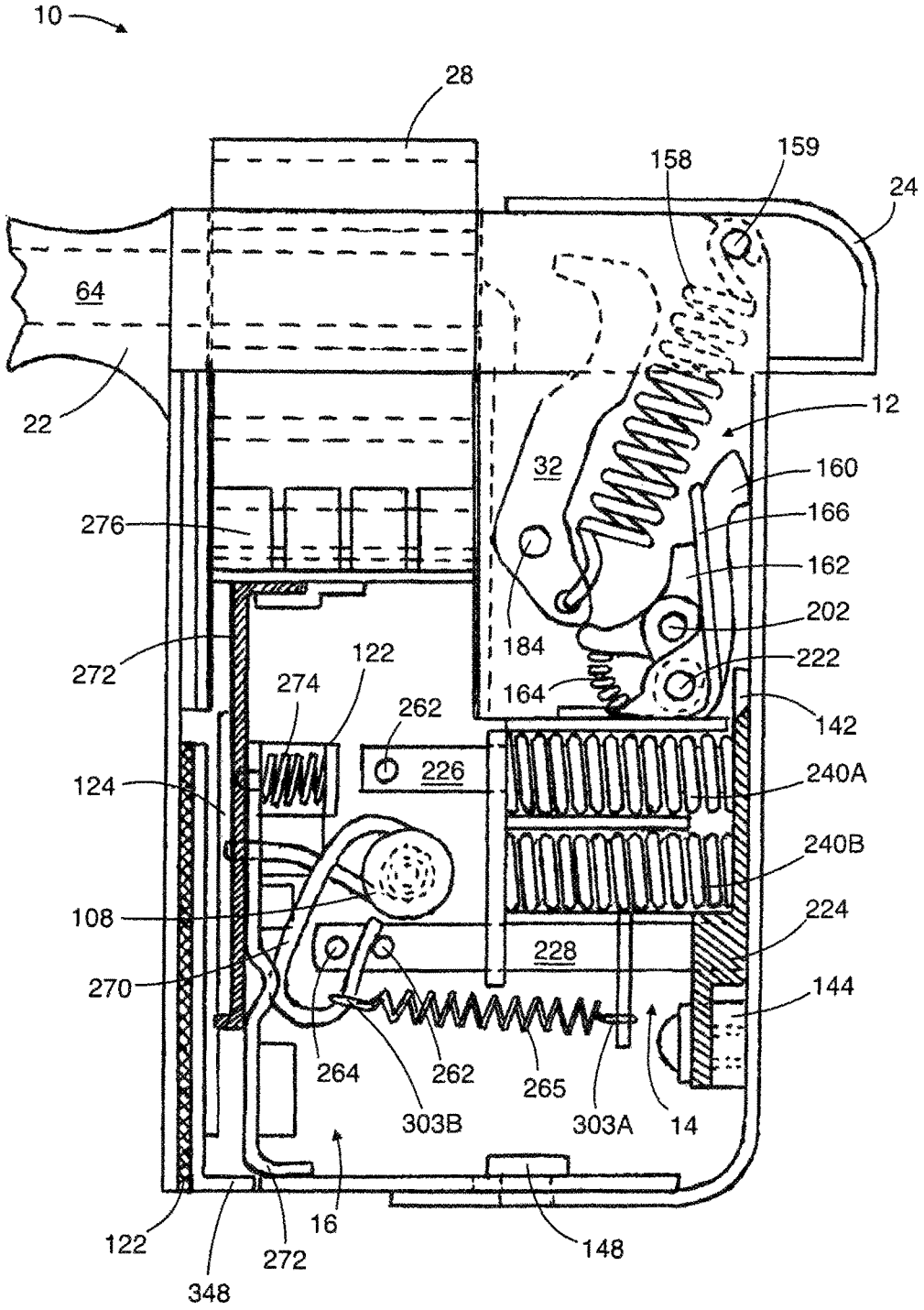
FIG. 29 illustrates a partial cut away side plan view of the handgun of FIGS. 1 and 2 in a position with the trigger handle between the first position and the second position.

A rivet 148 may be attached to the bottom wall 138 of the trigger handle 20. The rivet 148 may be comprised of a head 150, a neck 152, and a stem 154 (FIG. 28). The head 150, neck 152, and stem 154 may all be cylindrical in shape. The head 150 may have the greatest diameter, the neck 152 may have a diameter smaller than the head 150, and the stem may have a diameter smaller than the neck 152. As best seen in FIG. 24, in diameter, the head 150 may substantially fill the distance between the side walls 136 of the trigger handle 20, while the neck 152 may be smaller in diameter, leaving spaces 156 on either side of the neck 152 between the head 150 and the bottom wall 138 of the trigger handle 20. The rivet 148 may help to facilitate smooth sliding of the trigger handle 20 over the body 18. As described above, the trigger handle notch 104 of the back plate 90 also helps to facilitate the smooth sliding of the trigger handle 20 over the body 18. Working together, the trigger handle notch 104 and the rivet 148 facilitate the smooth sliding of the trigger handle 20 over the body 18. The neck 152 of the rivet 148 fits within the trigger handle notch 104 and a portion of the bottom wall 96 of the back plate 90 slides through the spaces 156 between the head 150 and the bottom wall 138 of the trigger handle 20. This is best illustrated in FIGS. 28 and 29 below. FIG. 28 shows the placement of the rivet 148 in the trigger handle notch 104 while the trigger handle 20 is in the first position, and FIG. 29 shows how the rivet 148 slides in the trigger handle notch 104 to a position where the trigger handle 20 is displaced between the first and second positions. When the trigger handle 20 is displaced to the second position, the rivet 148 meets the end of the trigger handle notch 104, preventing the trigger handle 20 from being displaced past this point.

Figure 25:
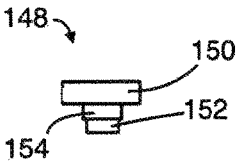
FIG. 25 illustrates a rivet of the trigger handle of FIGS. 23 and 24.

FIG. 25 illustrates a side plan view of the rivet 148 separated from the trigger handle. As mentioned above, the rivet 148 may be comprised of a head 150, a neck 152, and a stem 154. The diameter of the stem 154, may preferably be smaller than the diameter of the neck 152. The stem 154 may be secured in the bottom wall 138 of the trigger handle 20 with the neck 152 resting on the floor of the bottom wall 138.

Figure 26:
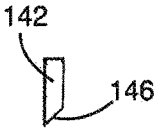
FIG. 26 illustrates a side plan view of a rod base stop of the trigger handle of FIGS. 23 and 24.
Figure 27:
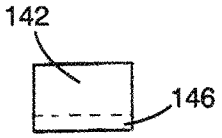
FIG. 27 illustrates a front plan view of the rod base stop of FIG. 26.

FIGS. 26 and 27 illustrate a front and a side plan view respectively of the rod base stop 142. As described above, the rod base stop 142 may generally be a rectangular prism in shape. The angled cut 146 may be cut into the bottom portion of the rod base stop 142, forming an angle which corresponds to a wedge 234 in the rod base 224 which will be described in more detail below.

Now that the basic structure of the outer components of the handgun 10 have been described in detail, the inner mechanisms of action in the handgun 10 will be described. First, the firing mechanism 12 will be described, followed by the trigger force mechanism 14 and the magazine lift mechanism 16. The outer components of the handgun 10 may be designed to secure and protect the mechanisms of action, and also to allow for the smooth operation of the mechanisms as will be seen in greater detail below.

FIGS. 28 and 29 illustrate side plan views of the firing mechanism 12, the trigger force mechanism 14, and the magazine lift mechanism 16 as they operate in the handgun 10. FIG. 28 illustrates the mechanisms 12, 14, and 16 when the trigger handle 20 is in the first position. FIG. 29 illustrates the mechanisms 12, 14, and 16, when the trigger handle is in a position between the first and the second positions. The mechanisms 12, 14, and 16, will be described in general detail as whole units, followed by the unique features of each component of the mechanisms.

The firing mechanism 12 may be disposed in the upper back quarter of the handgun 10. The firing mechanism 12 may be comprised of the hammer 32, a hammer spring 158, a hammer lever 160, a hammer lever rider 162, a lever rider spring 164, and a lever torsion spring 166. Generally, the firing mechanism 12 functions to strike a bullet in the magazine 28 and consequently fire the bullet out of the barrel 22. As can be seen from FIGS. 28 and 29, when the trigger handle 20 is displaced from the first position, the hammer lever 160 pivots on its axis and in so doing moves the hammer lever rider 162 forward and down. By moving forward and down, the hammer lever rider 162 contacts an end of the hammer 32 causing the hammer 32 to cock backwards. This stretches and builds the potential energy in the hammer spring 158. Once the trigger handle 20 is reaches the second position, the hammer lever rider 162 will slip past and loose contact with the hammer 32 causing the hammer spring 158 to relax, turning the potential energy into kinetic energy, and causing the hammer 32 to snap forward to strike a bullet in the magazine 28. Consequently, the bullet will be fired out of the barrel 22 of the handgun 10.

When the trigger handle 20 is released to return to its first position, the hammer 30 is resting in one of the bullet chambers 80 of the magazine 28 and the hammer spring 158 is in its first position. The lever torsion spring 166 pushes back on the hammer lever 160 to keep the hammer lever 160 in contact with the trigger handle 20. The hammer lever rider 162 comes again into contact with the hammer 32 as it is moved back to the starting position. The contact with the hammer 32 causes the lever rider spring 164 to compress, allowing the hammer lever rider 162 to slip past the hammer 32 and back to the starting position.

Figure 31:
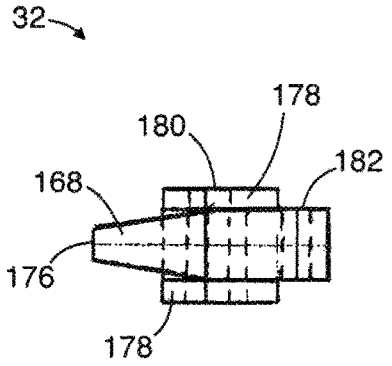
FIG. 31 illustrates a top plan view of the hammer of FIG. 30.
Figure 30:
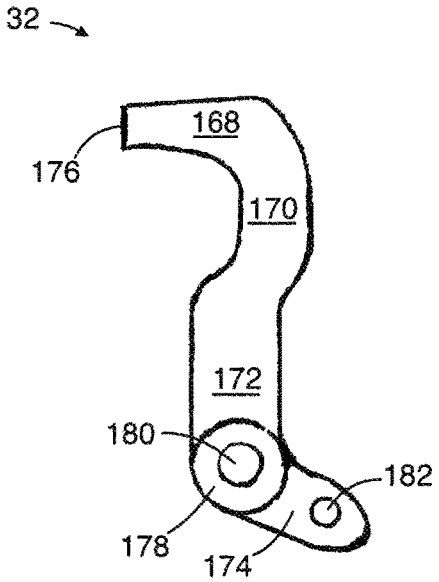
FIG. 30 illustrates a side plan view of a hammer of the handgun of FIGS. 1 and 2.
Figure 32:
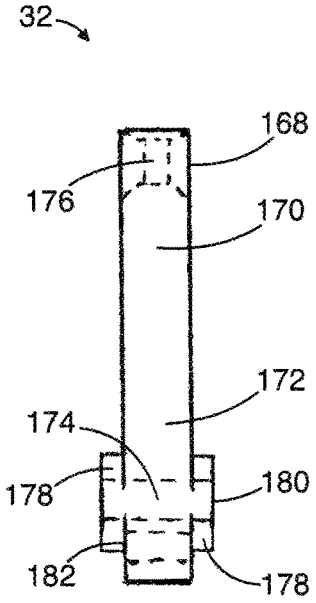
FIG. 32 illustrates a back plan view of the hammer of FIGS. 30 and 31.

FIGS. 30-32 illustrate a side, top, and back plan view respectively of the hammer 32. The hammer 32 may generally be comprised of a head 168, a curved neck 170, a stem 172, and a body 174. The head 168 narrows to a tip 176. The tip 176 strikes the primer of the bullet, and consequently fires the bullet. The curved neck 170 may be just inferior to the head 168. The curved neck 170, allows the head 168 to be of sufficient length to pass through the hammer notch 30 to strike a bullet chambered in the magazine 28. The stem 172 may be just inferior to the curved neck 170 and may be tall enough to place the head 168 at the right height to pass through the hammer notch 30 to strike a bullet. The body 174 may be just inferior to the stem 172, and forms about a forty-five-degree angle in relation to the stem 172. The body 174 may be comprised of a pair of spacers 178, a pivot aperture 180, and a hammer spring aperture 182. The spacers 178 are preferably cylindrical in shape with one on either side of the body 174. The spacers 178 keep the hammer 32 centered when it cocks back and snaps forward as they minimize the space between the hammer 32 and the side walls 114 of the hammer base 110. The hammer 32 may be held in position in the hammer base 110 via the pivot aperture 180, the hammer apertures 116 of the hammer base 110, and a hammer pin 184. The pivot aperture 180 may be placed in line with the hammer apertures 116, and the hammer pin 184 may be inserted through the hammer apertures 116 and the pivot aperture 190. This allows the hammer 32 to be secured in the hammer base 110 and also to pivot about the axis of the hammer pin 184. The hammer spring aperture 182 provides a point of connection for one end of the hammer spring 158 to attach to the hammer 32. A second end of the hammer spring 158 may attach to the hammer spring pin 159 described above. While it will be recognized that a number of different springs may be used as the hammer spring 158, it is preferable that a hammer spring 158 is used having approximately one and a half millimeter wire and about fourteen coils.

Figure 33:
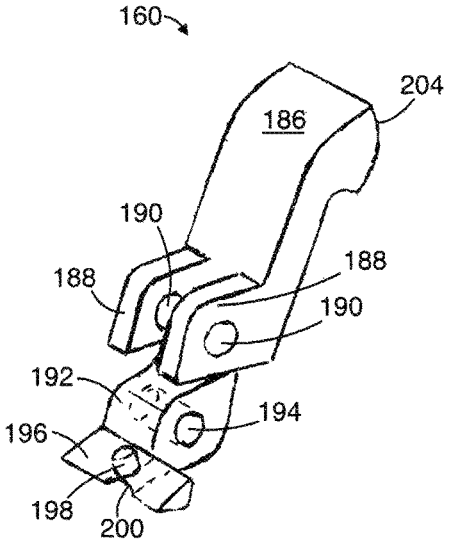
FIG. 33 illustrates a perspective view of a hammer lever of the handgun of FIGS. 1 and 1.
Figure 35:
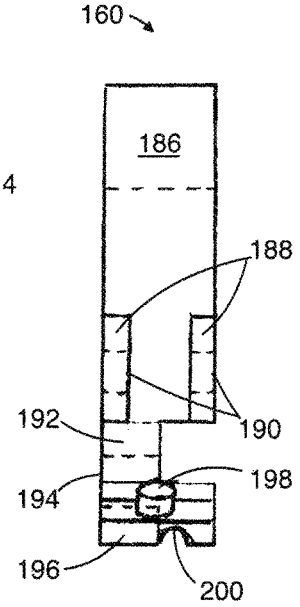
FIG. 35 illustrates a front plan view of the hammer lever of FIGS. 33 and 34.
Figure 34:
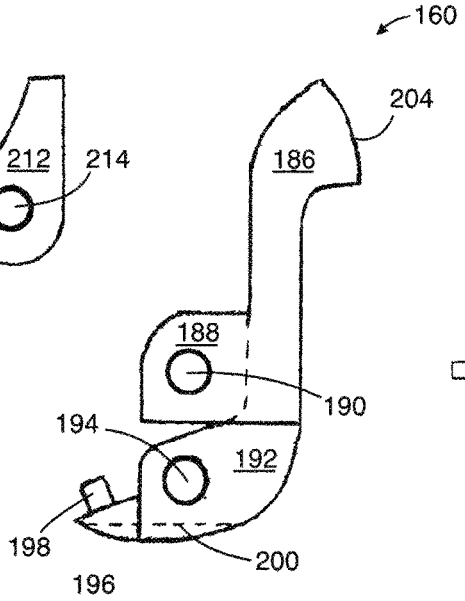
FIG. 34 illustrates a side plan view of the hammer lever of FIG.

FIGS. 33-35 illustrate a perspective, side plan, and front plan view respectively of the hammer lever 160. The hammer lever 160 may be comprised of a head 186, arms 188, arm apertures 190, a body 192, a body aperture 194, a tail 196, a spring peg 198, and a spring notch 200. The hammer lever 160 may be secured in the handgun 10 by the body aperture 194, the hammer lever apertures 118 of the hammer base 110, and a hammer lever pin 202. The body aperture 194 may be aligned with the hammer lever apertures 118, and the hammer lever pin 202 is inserted through the apertures 118 and 194. The hammer lever 160 may be able to pivot about the axis of the hammer lever pin 202. The head 186 may be comprised of a curved surface 204 which always contacts the back wall 140 of the trigger handle 20. The curve in the curved surface 204 may help to facilitate the smooth movement of the trigger handle 20 as it is displaced from the first position and slides over the body 18. The arms 188 may be spaced apart such that the hammer lever rider 162 may fit between the arms 188 and be secured by a hammer lever rider pin 220 inserted through the arm apertures 190. The tail 196 and the body 192 may be curved at the bottom, allowing the hammer lever 196 to pivot as the tail 196 and the body 192 rock back and forth on an upper handle spring separator 132A. A spring peg 198 is disposed on a top surface of the tail 196 and functions as a point of attachment for the lever rider spring 164. A spring notch 200 may be formed into the bottom surface of the tail 196 and functions to help to secure the lever torsion spring 166 to the hammer lever 160.

Figure 36:
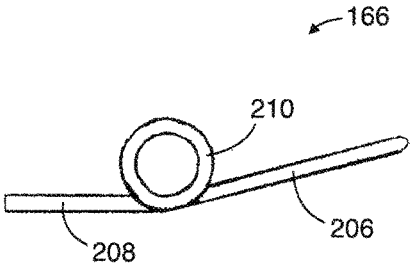
FIG. 36 illustrates a side plan view of a lever torsion spring of the handgun of FIGS. 1 and 2.

FIG. 36 illustrates a side plan view of the lever torsion spring 166. The lever torsion spring spring 166 may be comprised of a first arm 206, a second arm 208, and one or more coils 210. The first and second arms 206 and 208 form about a one hundred and sixty-five-degree angle in relation to each other when the lever torsion spring 166 is in the relaxed position. It is preferable that the lever torsion spring 166 may be comprised of two coils 210. The lever torsion spring 166 may be secured to the hammer lever 160 by aligning the coils 210 with the body aperture 194 of the hammer lever 160 and inserting the hammer lever pin 202 through the coils 210 and the body aperture 194. When the lever torsion spring 166 is secured to the hammer lever 160, the first arm 206 is disposed along the head 186 and the second arm 208 is disposed through the spring notch 200.

Figure 38:
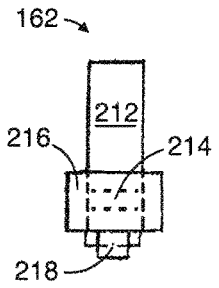
FIG. 38 illustrates a front plan view of the lever rider of FIG. 37.
Figure 37:
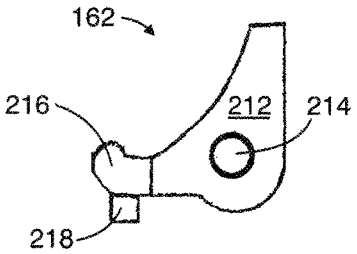
FIG. 37 illustrates a side plan view of a lever rider of the handgun of FIGS. 1 and 2.

FIGS. 37 and 38 illustrate a side and a back plan view respectively of the hammer lever rider 162. The hammer lever rider 162 may be comprised of a body 212, a body aperture 214, a hammer arm 216, and a spring peg 218. The hammer lever rider 162 may be secured to the hammer lever 160 by aligning the body aperture 214 with the arm apertures 190 of the hammer lever 160. A hammer lever rider pin 220 may then be inserted through the apertures, allowing the hammer lever rider 162 to pivot about the axis of the hammer lever rider pin 220. The hammer arm 216 comes into contact with the hammer 32 when the handgun is fired. When the trigger handle 20 is displaced, the hammer arm 216 presses against the hammer 32 and consequently the body 212 is pushed up against the hammer lever rider 162. One the hammer arm 216 is pushed all the way forwards by the displacement of the trigger handle 20, the hammer arm 216 slips past the hammer 32 and the hammer 32 snaps forward. When the trigger handle 20 is slide back to the first position, the hammer arm 216 pulls against the hammer 32 and slips past the hammer back to its starting position.

The lever rider spring 164 helps to push the hammer lever rider 162 back to its starting position. The lever rider spring 164 attaches to the spring peg 218 and also to the spring peg 198 of the hammer lever 160. In its relaxed position, the lever rider spring 164 pushes the hammer lever rider 162 up against the hammer lever 162. The lever rider spring 164 is only compressed when the trigger handle 20 is released and headed back to its first position. As described above, when the trigger handle 20 is headed back to its first position, the hammer arm 216 pulls against the hammer 30. When this happens, the lever rider spring 164 is compressed to allow the hammer arm 216 to slip past the hammer 30 and back to the starting position.

With reference again to FIGS. 28 and 29, the trigger force mechanism 14 may be disposed in the lower back quarter of the handgun 10. The trigger force mechanism 14 may be comprised of a rod base 224, an upper rod 226, a lower rod 228, a handle spring base 130, an upper handle spring separator 132A, a lower handle spring separator 132B, a rod guide 134, an upper trigger handle spring 240A, and a lower trigger handle spring 240B. Generally, the trigger force mechanism 14 functions to provide a force against the displacement of the trigger handle 20 from the first position to the second position, and also to return the trigger handle 20 to its first position after it has been displaced from the first position to the second position.

Figure 40:
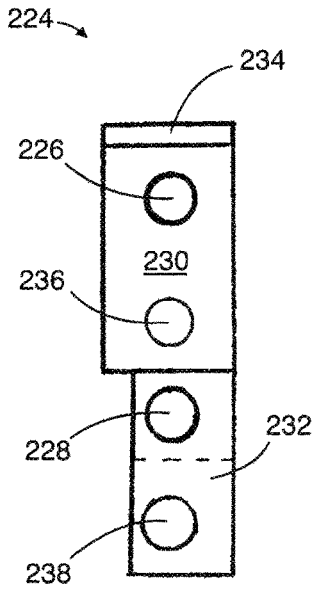
FIG. 40 illustrates a front plan view of the rod base and rods of FIG. 39.
Figure 39:
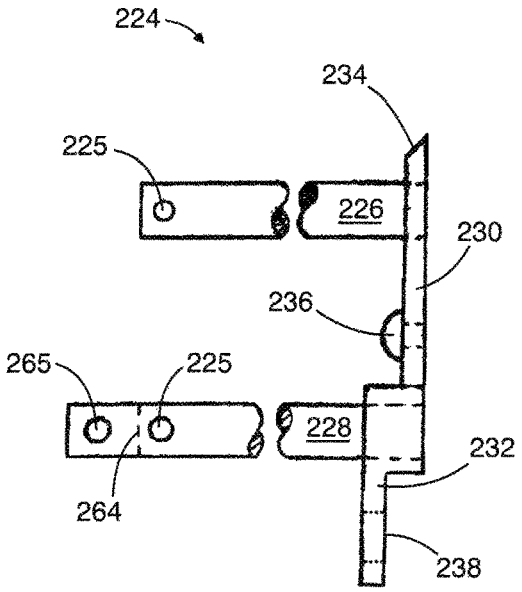
FIG. 39 illustrates a side plan view of a rod base and rods of the handgun of FIGS. 1 and 2.

FIGS. 39 and 40 illustrate a side and a front plan view respectively of the rod base 224 and rods 226 and 228. The rod base 224 may be comprised of an upper portion 230 and a lower portion 232. The upper portion 230 is comprised of a wedge 234, the upper rod 226, and a lower spring peg 236. The lower portion 232 may be comprised of the lower rod 228 and an aperture 238. The lower portion 232 may be raised and has a smaller width than the upper portion 230. This allows the lower portion 232 to clear the back plate 90 of the body 18 when the trigger handle 20 is displaced to the second position. The rod base 224 and rods 226 and 228 are secured to the trigger handle 20 by the wedge 234 of the upper section 230 and by the aperture 238 of the lower section 232. The wedge 234 may be cut to correspond with the angled cut 146 of the rod base stop 142 (FIGS. 23, 24, 26, and 27) such that the wedge 234 may slide into and be secured in the angled cut 146 of the rod base stop 142. When the wedge 234 is secured in the angled cut 146, the aperture 238 is aligned with the rod base nut 144. A screw or bolt may then be inserted through the aperture and threaded to the rod base nut 144 to secure the rod base 224 to the trigger handle 20. It is preferable that a screw and lock washer are used with the rod base nut 144 to secure the rod base 224.

With reference back to FIGS. 20 and 21, the arrangement of the handle spring base 130, the handle spring separators 132, and the rod guide 134 can best be seen. The handle spring base 130, handle spring separators 132, and rod guide 134 are all preferably angle bars and secured to the side wall 98 of the back plate 90 by weld or may be molded as one piece with the back plate 90. The handle spring base 130 and the rod guide 134 are secured in vertical positions to the side wall 98. The handle spring separators 132 are secured to the side wall 98 in horizontal positions behind the handle spring base 130 and above the rode guide 134.

Figure 41:
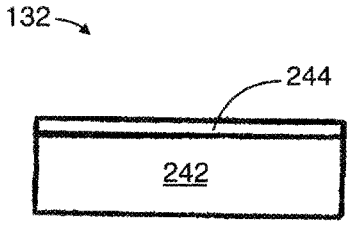
FIG. 41 illustrates a side plan view of a spring separator of FIGS. 20 and 21.
Figure 42:
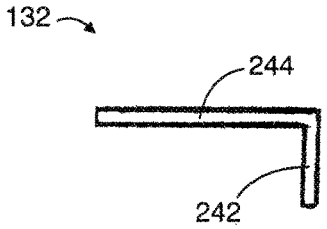
FIG. 42 illustrates a back plan view of the spring separators of FIGS. 20, 21, and 41.

FIGS. 41 and 42 illustrate a side and a front plan view respectively of the handle spring separators 132. The handle spring separators 132 have a side wall 242 and a top wall 244. The side wall 242 may be secured to the side wall 98 of the back plate 90 as described above. The top wall 244 functions to separate the trigger handle springs 240 from each other and from other components of the handgun 10, thereby allowing the trigger handle springs 240 to compress and relax without becoming tangled with each other or with other components of the handgun 10.

Figure 43:
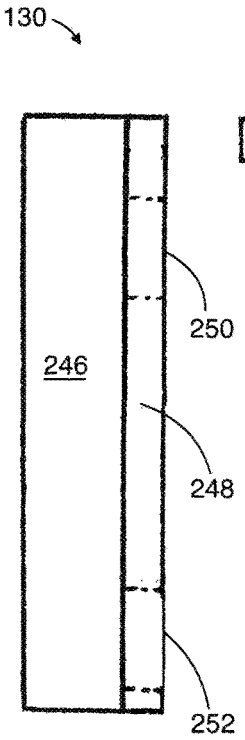
FIG. 43 illustrates a side plan view of the spring base of FIGS. 20 and 21.
Figure 44:
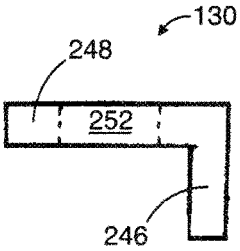
FIG. 44 illustrates a bottom plan view of the spring base of FIGS. 20, 21, and 43.

FIGS. 43 and 44 illustrate a side and a top plan view respectively of the handle spring base 130. The handle spring base 130 has a side wall 246 and a back wall 248. The side wall 246 may be secured to the side wall 98 of the back plate 90 as described above. The back wall 248 has two main functions. First, the back wall 248 may be a base for the trigger handle springs 240 such that the trigger handle springs 240 may be compressed when the trigger handle 20 is displaced by the user so as to be slid over the body 18. Second, the back wall 248 acts as a support to the upper rod 226 and the lower rod 228. An upper rod aperture 250 may be located near the top portion of the back wall 248 and a lower rod aperture 252 may be located below the upper rod aperture 250 and near the bottom portion of the back wall 248. The upper rod 226 and the lower rod 228 extend through the upper rod aperture 250 and the lower rode aperture 252 respectively.

Figure 45:
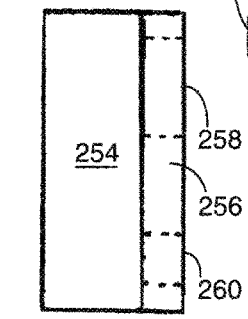
FIG. 45 illustrates a side plan view of the rod guide of FIGS. 20 and 21.
Figure 46:
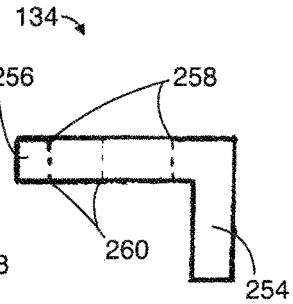
FIG. 46 illustrates a bottom plan view of the rod guide of FIGS. 20, 21, and 45.

FIGS. 45 and 46 illustrate a side and a top plan view respectively of the rod guide 134. The rod guide 134 has a side wall 254 and a back wall 256. The side wall 254 may be secured to the side wall 98 of the back plate 90 as described above. The back wall 256 has two main functions. First, the back wall 256 adds further support to the lower rod 228 and helps to guide the lower rod 228 when the trigger handle 20 is displaced by the user. This is accomplished by a rod aperture 258, which is located near the top portion of the back wall 256, through which the lower rod 258 extends. Second, the back wall 256 secures a lift reset spring 268. The lift reset spring 268 is part of the magazine lift mechanism 16 and will be described in further detail bellow. A spring aperture 260 is located near the bottom portion of the rod guide 134 and below the rod aperture 258. A portion of the lift reset spring 268 may pass through the spring aperture 260 and be secured to the rod guide 134.

With reference back to FIGS. 28 and 29 the upper rod 226 may be disposed through the upper trigger handle spring 240A such that the upper trigger handle spring 240A is between the rod base 224 and the handle spring base 130. The lower trigger handle spring 240B may be disposed between the upper trigger handle spring 240A and the lower rod 228. The lower trigger handle spring 240B may be separated from the upper trigger handle spring 240A by the lower handle spring separator 132B. The ends of the lower trigger handle spring 240B, may be secured to the rod base 224 and the handle spring base 130 by lower spring pegs 236.

The trigger handle springs 240 play an important role as a safety feature of the handgun 10. As described above, the trigger handle springs 240 determine the pressure required to displace the trigger handle 20 and to consequently fire the handgun 10 because the trigger handle springs 240 are compressed when the trigger handle 20 is displaced and thus exert a force on the trigger handle 20. It is preferable that the trigger handle springs 240 are identical and that they have spring force constants that are great enough such that a child is unable to compress the trigger handle 20 and fire the handgun 10, but small enough that the average adult is able to compress the trigger handle 20 and fire the handgun 10. Preferably, the effective spring force constant of the trigger handle springs 240 as arranged in parallel is about 12,500 Newtons per Meter to about 19,000 Newtons per Meter. It will be recognized by one skilled in the art, that the trigger handle springs 240 may be switched to similar sized springs with differing springs constants such that the pressure required to fire the handgun 10 may be adjusted to the preferences of the user.

The upper rod 226 and the lower rod 228 both have apertures 225 through which stop pins 262 by be inserted. The stop pins 262 are longer in length than the diameter of the upper rod 226 and the diameter of the lower rod 228. Thus, when the upper and lower rods 226 and 228 are in place through the handle spring base 130, the stop pins 262 prevent the upper and lower rods 226 and 228 from sliding out of the handle spring base 130. For example, when the trigger handle 20 is displaced, the trigger handle springs 240 are compressed and the upper and lower rods 226 and 228 slide forward through the handle spring base 130. When the trigger handle 20 is released, the trigger handle springs 240 push the trigger handle back to its starting position being stopped by the stop pins 262 hitting the handle spring base 130. The lower rod 228 has a spring slot 264 in the end proximal to the stop pin 262. The spring slot holds a lift spring 270 which will be discussed in more detail bellow. A second aperture 265 is located at the proximal end of the lower rod 228 and a holding pin 266 may be inserted to hold the lift spring 270 in the spring slot 264.

Again, with reference to FIGS. 28 and 29, the magazine lift mechanism 16 may be disposed in the lower front quarter of the handgun 10. The magazine lift mechanism 16 may be comprised of the lower rod 228, the rod guide 134, the lift reset spring 268, the lift spring 270, the fulcrum cover nut 108, the lift spring guide 126, a lifter 272, the lifter stop 124, the lift anchor 128, a lift anchor spring 274, and a magazine clip 276. Generally, the magazine lift mechanism 16 functions to lift the magazine 28 to place a chambered bullet in line with the bore 64 such that the hammer 32 may strike the bullet. For example, when the trigger handle 20 is displaced from the first position, the lower rod 228 moves forward and consequently causes the lift spring 270 to first move forward and second to pivot about the fulcrum cover nut 108. When the lift spring 270 moves forward, an arm 304 of the lift spring 270 inserts into a spring aperture 298 of the lifter 272. When the lift spring 270 pivots, the arm 304 of the lift spring 270 pushes the lifter 272 upwards. The lift spring 270 is guided during its movements by a spring slot 264 in the lift spring guide 126. As the lifter 272 moves upwards, the lift anchor spring 274 is compressed, removing a forked stop peg 360 from a set of stop apertures 296 in the lifter 272. The lifter 272 may be attached to the magazine clip 276, in which the magazine 28 is clipped, such that the magazine 28 is lifted upwards. Once the forked stop peg 360 reaches the next set of stop apertures 296, the lift spring 270 can no longer push the lifter 272 upwards, and the lift anchor spring 274 relaxes and pushes the stop peg 360 into the next set of stop apertures 296 to prevent the lifter 272 from falling back down. When the trigger handle 20 and returns back to its first position, the lower rod 228 pulls the lift spring 270 back to its starting position. The lift reset spring 268 helps to facilitate a smooth transition of the lift spring 270 back to its starting position.

With reference back to FIGS. 20 and 21, the arrangement of some of the components of the magazine lift mechanism 16 may be easily seen. The lifter stop 124 is disposed vertically next to the cover rest 122. The lifter stop 124 may be secured to the side wall 98 of the back plate 90 by tap weld, screws, or by other methods known in the art. A gap 300 may be left between the lifter stop and the lift spring guide 126. The lifter 272 fits and may be displaced up and down in the gap 300 as described above. The lift spring guide 126 and lift anchor 128 are disposed vertically in line with each other with the lift anchor 128 superior to the lift spring guide 126. Both the lift spring guide 126 and the lift anchor 128 may also be secured to the side wall 98 by weld, screw, or other by other methods known in the art.

Figure 47:
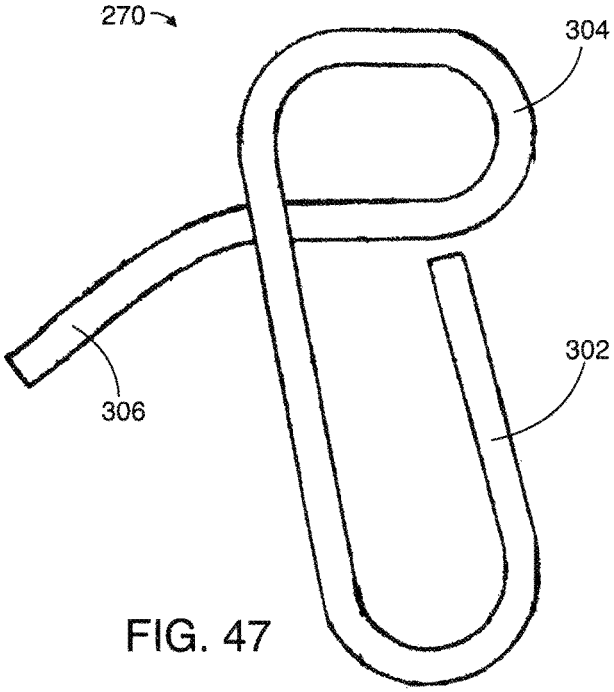
FIG. 47 illustrates a side plan view of a lift spring of the handgun of FIGS. 1 and 2.

FIG. 47 illustrates a side plan view of the lift spring 270. The lift spring 270 may be comprised of a hook 302, a coil 304, and an arm 304. The wire of the lift spring 270 first bends to form the hook 302. Then, following the wire, the wire bends in a loop to form the coil 304 with the wire then passing under itself and extending at a slight angle downwards to form the arm 304. As described previously, the end of the hook 302 is placed in the spring slot 264 of the lower rod 228 and secured in place by the holding pin 266. The coil 304 wraps around the fulcrum cover nut 108. The coil 304 is oval in shape such that it can move forward or backwards and also pivot about the fulcrum cover nut 108. When in the relaxed position, the arm 304 is held in a spring catch bend 286 of the lift spring guide 126. When the trigger handle 20 is displaced from the first position, the lower rod 228 pushes on the hook 302, this in turn causes the coil 304 to move forward until it is stopped by the fulcrum cover nut 108. At this point, the coil pivots about the fulcrum cover nut 108 as the lower rod 228 continues to push the hook 302 forward. The pivoting of the coil 302 causes the arm 306 to lift upwards.

With reference back to FIGS. 28 and 29, the lift reset spring 258, while optional, is beneficial as it helps to make the movement of the lift spring 270 smoother, and thus, more reliable. The lift reset spring 258 is preferably about twelve millimeters long with about ten coils that are about three millimeters in diameter. The lift reset spring 258 may be comprised of two hooks 308 on either end, which may be included with the measurement of the length of the spring which is about 12 millimeters. One hook 308A is secured through the spring aperture 260 of the rod guide 134, while the other hook 308B is secured around a portion of the hook 302 of the lift spring 270. In the relaxed position, the end of the hook 302 of lift spring 270 rests against the stop pin 262. When the trigger handle 20 is displaced from the first position and the lower rod 228 begins to push the hook 302 forward and the end of the hook 302 moves from resting on the stop pin 262, to being pushed by the lower rod 228. During this movement, the lift rest spring 258 stretches and consequently applies a force against the forward movement of the hook 302 helping to secure the hook against the lower rod 228. When the trigger handle 20 starts to move back to its first position, and the lower rod 228 begins to pull the lift spring 270 back to Its starting position, the lift reset spring 258 begins to relax and consequently helps to pull the bottom portion of the hook 302 back into place.

Figure 49:
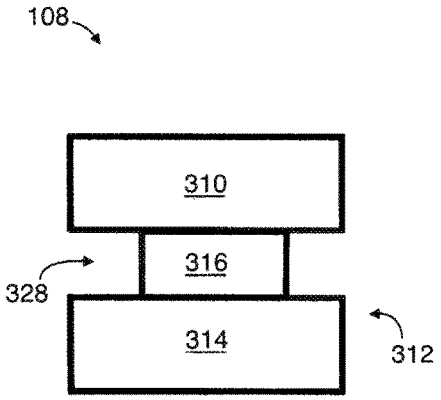
FIG. 49 illustrates a bottom plan view of the fulcrum cover nut of FIGS. 16-18 and 48.
Figure 48:
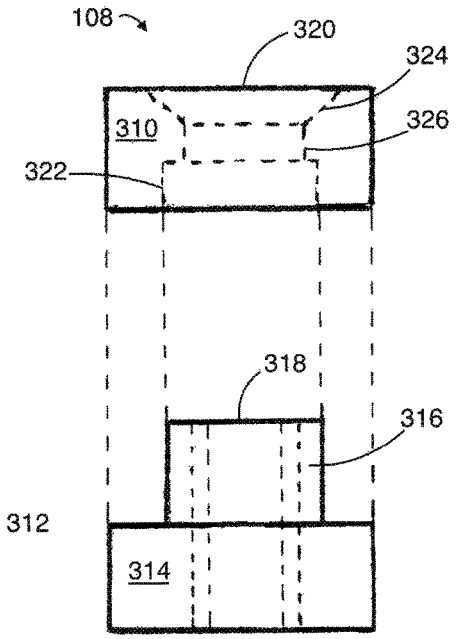
FIG. 48 illustrates an exploded bottom plan view of the fulcrum cover nut of FIGS. 16-18.

FIGS. 48 and 49 illustrates an exploded view of the fulcrum cover nut 108. The fulcrum cover nut 108 may be comprised of the head 310 and the base 312. The base 312 may be comprised of a large cylinder 314 and a small cylinder 316. The small cylinder 314 may be superior to the large cylinder 314. A threaded aperture 318 may be disposed through the centers of the large and small cylinders 314 and 316. The head 310 may also be cylindrical in shape and preferably has the same diameter as the large cylinder 314. A screw aperture 320 may be disposed partially through the center and top portion of the head 310, while a base aperture 322 is disposed partially through the center and bottom portion of the head 310. The screw aperture 320 and base aperture 322 connect together so as to form one aperture through the head 310. The screw aperture 320 has a portion that varies in diameter 324 such that a screw may be inserted with the head of the screw lying flush with the top surface of the head 310 of the fulcrum cover nut 108, and a portion with a constant diameter 326 which may preferably be the same diameter as the threaded aperture 318 of the base 312. The base aperture 322 preferably has the same diameter as the small cylinder 316 such that the small cylinder 316 may fit into the base aperture 322 when the head 310 is place over the base 312. When the head 310 is placed over the base 312, a portion of the small cylinder 316 is left uncovered by the head 310. This uncovered portion of the small cylinder 316 forms a lift spring slot 328 in which the coil 308 wraps around the small cylinder 316. Preferably, the minor axis of the coil 308 is smaller in length than the diameter of the large cylinder 314 and the head 310, but larger in length than the small cylinder 316 such that the coil 308 is able to wrap around the small cylinder 316 when in the lift spring slot 328 and be secured in the lift spring slot 328 by the large cylinder 314 and the head 310.

Figure 50:
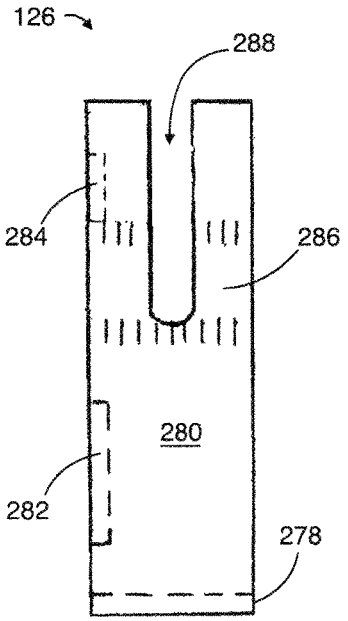
FIG. 50 Illustrates a front plan view of the lift guide of FIGS. 20 and 21.
Figure 51:
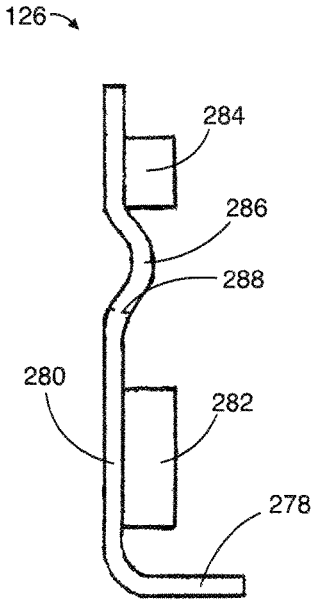
FIG. 51 illustrates a side plan view of the lift guide of FIGS. 20, 21 and 50.

FIGS. 50 and 51 illustrate a front and a side plan view respectively of the lift spring guide 126. The lift spring guide 126 is comprised of a bottom wall 278, a front wall 280, a bottom side tab 282, a top side tab 284, a spring catch bend 286, and a spring notch 288. Generally, the lift spring guide 126 functions to guide the arm 306 of the lift spring 270 as it lifts the lifter 272 when the trigger handle 20 is displaced by the user. The bottom wall 278 may be secured to the bottom wall 96 of the back plate 90 by weld, screw, or by any other manner known in the art. The top and bottom side tabs 284 and 282 may similarly be secured to the side wall 98 of the back plate 90. The top side tab 284 is disposed near the top portion of the front wall 280, while the bottom side tab 282 is disposed near the bottom portion of the front wall 280. The spring catch bend 286 is disposed in the front wall 280 in between the top side tab 284 and the bottom side tab 282. The spring catch bend 286 functions to catch the arm 304 of the lift spring 270 as it resets after the handgun 10 is fired. The spring notch 288 is disposed vertically down the middle of the front wall 280 and centrally with respect to the width of the front wall 280. The spring notch 288 functions to guide the arm 304 of the lift spring 270 as the arm 304 lifts the lifter 272 upon the compression of the trigger handle 20 and also guides the arm 304 as the arm 304 resets upon the release of the trigger handle 20.

Figure 52:
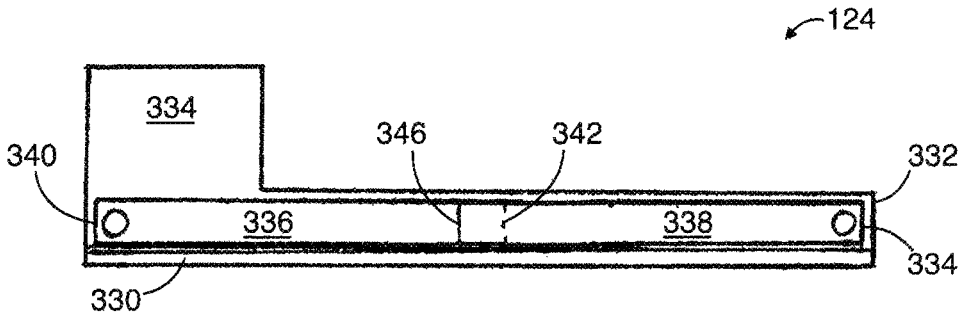
FIG. 52 illustrates a front plan view of the lifter stop of FIGS. 20 and 21.
Figure 53:
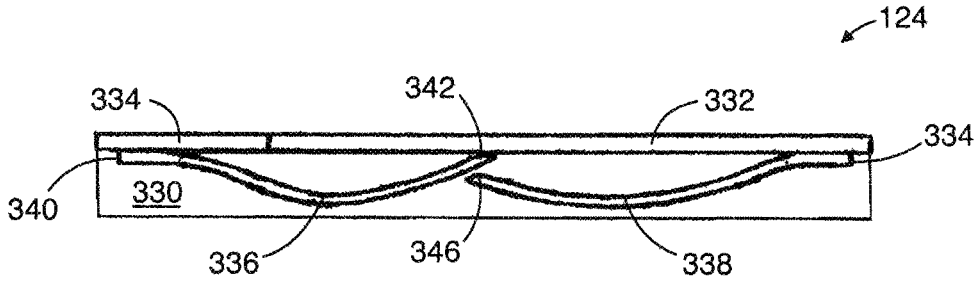
FIG. 53 illustrates a side plan view of the lift stop of FIGS. 20, 21, and 52.

FIGS. 52 and 53 illustrate a front and a side plan view respectively of the lifter stop 124. The lifter stop 124 may be comprised of a side wall 330, a back wall 332, a stop wall 334, a first leaf spring 336, and a second leaf spring 338. The side wall 330 may be secured to the side wall 98 of the back plate 90 by weld, screw, or by any other method known in the art. The back wall 332 supports the first and second leaf springs 336 and 338 and also functions to guide the lifter 272 as it slides along the top of the back wall 332 when the trigger handle 18 is displaced from the first position. The stop wall 334 catches the lifter 272 once the lifter 272 has reached its maximum height, and prevents the lifter 272 from falling out of the handgun 10.

The first and second leaf springs 336 and 338 function to secure the poker 348 when it Is slid into the poker notch 100. The first leaf spring 336 is comprised of a first end 340 and a second end 342. The first end 340 of the first leaf spring 336 may be secured to a top portion of the stop wall 334, while the second end 342 is free to slide along the back wall 334 when the first leaf spring 336 is compressed by the poker 348. The second leaf spring 338 also has a first end 344 and a second end 346. The first end 344 of the second leaf spring 338 is secured near the bottom portion of the back wall 334. The second end 344 is free to slide along the first leaf spring 336 when it is compressed by the poker 348. The leaf springs 336 and 338 secure the poker 348 when it is slid into the handgun 10. When the poker 348 is inserted into the poker notch 100, the poker 348 slides in between the cover rest 122 and the lifter stop 124. The leaf springs 336 and 338 may be compressed by the poker 348 and consequently exert a force against the poker 348 to secure the poker 348 in place. It is preferable that two leaf springs are used in the handgun 10, but as will be recognized by one in the art, alternatively, one leaf spring or three or more leaf spring may be used to secure the poker 348.

Figure 54:
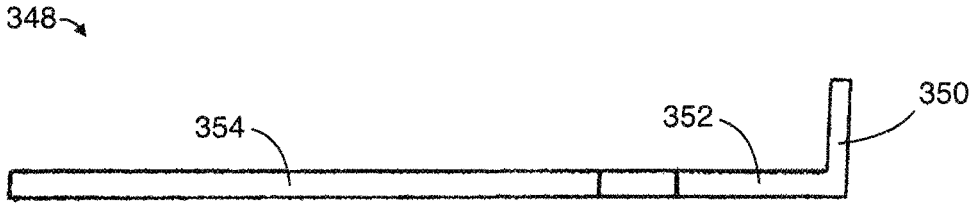
FIG. 54 illustrates a side plan view of a poker of the handgun of FIGS. 1 and 2.
Figure 55:
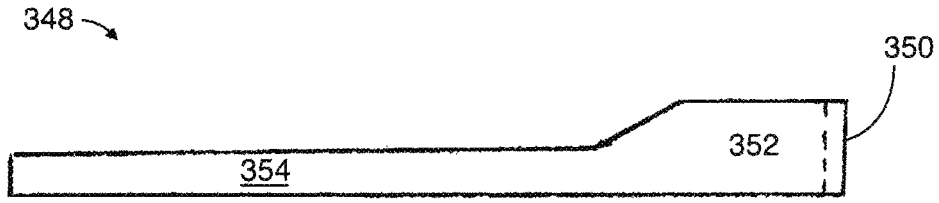
FIG. 55 illustrates a front plan view of the poker of FIG. 54.

FIGS. 54 and 55 illustrate a front and a side plan view respectively of the poker 348. The poker 348 functions to remove bullet casings from the magazine 28 after the bullets are fired. The poker 28 is comprised of a bottom wall 350, a grip wall 352, and a poker wall 354. The bottom wall 350 functions to provide a smooth and closed exterior of the body 18 of the handgun 10 when the poker 348 is stored and secured in the body 18. The grip wall 352 functions to provide a place to hold the poker 348 when it is used to remove bullet casings from the magazine 28. The height of the walls of the poker 348 narrows from the grip wall 352 to the poker wall 354 such that the poker wall 354 is narrower in height than the grip wall 352. The narrow height of the poker wall 354 allows the poker wall 354 to be inserted inside of the bullet chambers 80 of the magazine 28 in order to remove the bullet casings from the magazine 28.

Figure 56:
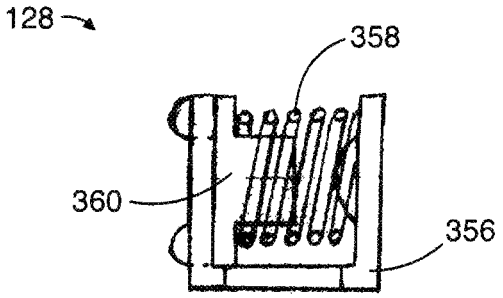
FIG. 56 illustrates a bottom plan view of the lift anchor of FIGS. 20 and 21.
Figure 57:
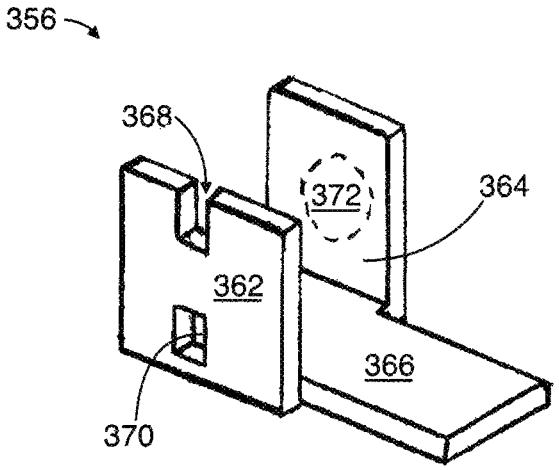
FIG. 57 illustrates a perspective view of a lift anchor base of the lift anchor of FIG. 56.
Figure 58:
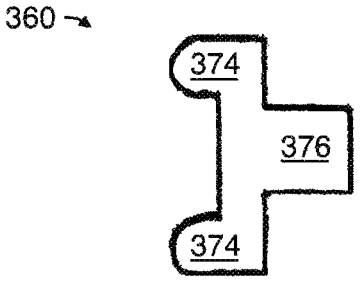
FIG. 58 illustrates a bottom plan view of a forked peg of the lift anchor of FIG. 56.

FIGS. 56-58 illustrate the lift anchor 128 and components of the lift anchor 128. FIG. 56 Illustrates a bottom plan view of the lift anchor 128, FIG. 57 illustrates a perspective view of an anchor base 356, and FIG. 59 illustrates a top plan view of a forked peg 360 of the lift anchor 128.

The lift anchor 128 is comprised of an anchor base 356, an anchor spring 358, and a forked peg 360. The anchor base 356 is comprised of a peg wall 362, a spring wall 364, and a side wall 366. The peg wall 362 and the spring wall 364 form ninety degree angles with the side wall 366. A peg slot 368 and a peg aperture 370 are disposed in the peg wall 362. A spring knob 372 is disposed on the center face of the spring wall 364 and facing the peg wall 362. The spring knob 372 secures one end of the anchor spring 358. The forked peg 360 is comprised of two pegs 374 and a spring knob 376 and is disposed in between the peg wall 362 and the spring wall 364 of the anchor base 356. The pegs 374 are separated so as to extend through the peg slot 368 and the peg aperture 370 of the anchor base 356. The spring knob 376 faces the spring knob 372 of the anchor base 356. The anchor spring 358 may be secured between and by the spring knobs 376 and 272.

When the lifter 272 is displaced vertically by the lift spring 270, the forked peg 360 is pushed back into the anchor base 356, but not so far in that the pegs 374 are completely removed from the peg slot 368 and the peg aperture 370, but are flush with the peg wall 362. This causes the anchor spring 358 to be compressed. With the pegs 374 flush with the peg wall 362, the lifter 272 is able to be displaced vertically until the next set of stop apertures 296 is aligned with the pegs 374. At this point, the anchor spring 358 relaxes and pushes the pegs 374 into the set of stop apertures 296, whereby the pegs 374 secure the lifter 272 in place such that it does not slip back down.

Figure 59:
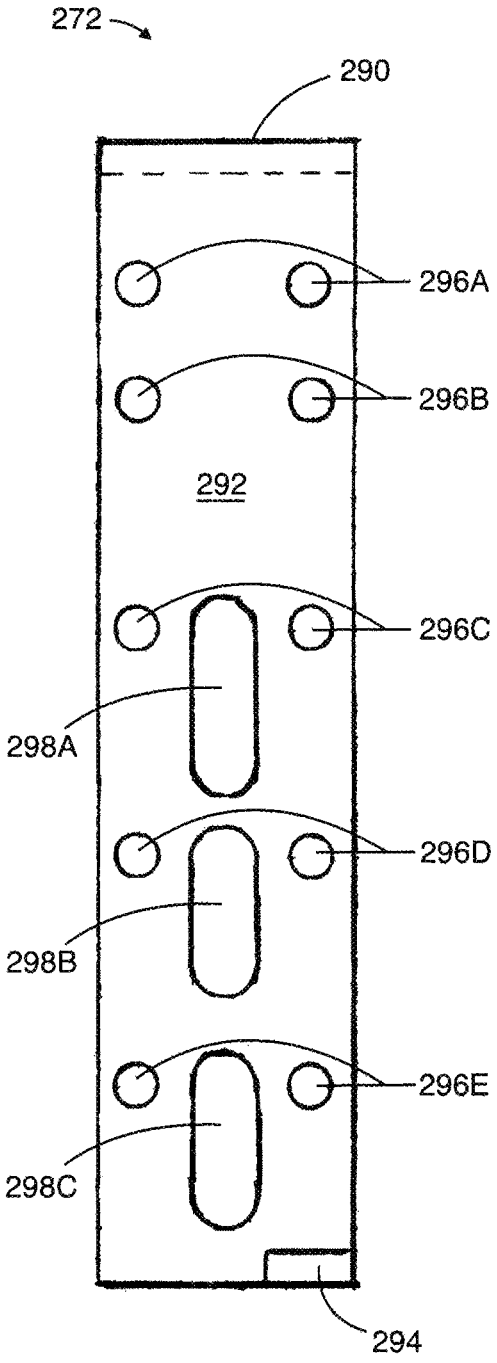
FIG. 59 illustrates a front plan view of the lifter of FIGS. 20 and 21.
Figure 60:
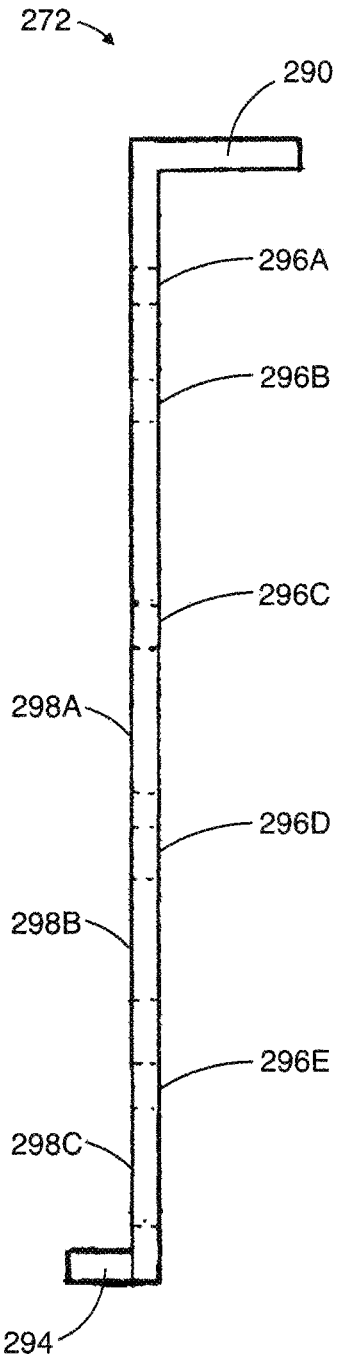
FIG. 60 illustrates a side plan view of the lifter of FIGS. 20, 21, and 59.

FIGS. 59 and 60 illustrate a side and a front plan view respectively of the lifter 272. As described above, the lifter may be disposed in the gap 300 between the lift guide 126 and the lifter stop 124. The lifter 272 is generally comprised of a top wall 290, a front wall 292, a stop tail 294, one or more sets of stop apertures 296, and one or more spring apertures 298. The top wall 290 forms a ninety-degree angle with the front wall 292 and functions to hook into a portion of the magazine clip 276 and to provide a flat surface to push the magazine clip 276 and the magazine 28 vertically. Each set of the one or more sets of stop apertures 296 preferably have two apertures which are on opposite sides of the front wall 292 with respect to the width of the front wall 292. The sets of stop apertures are spaced apart vertically along the length of the front wall 292. The pegs 374 of the lift anchor 128 insert into a set of apertures 296 each time the handgun 10 is shot causing the lifter 272 to be displaced vertically. The spring apertures 298 are preferably elongated ovals in shape and disposed spaced apart vertically along the center of the front wall 292 with respect to the width of the front wall 292. The stop tail 294 may be a small knob that forms a ninety-degree angle with front wall 292, and may be disposed in the bottom right corner of the front wall 292. The stop tail 294 slides along the top of the back wall 332 of the lifter stop 124 as the lifter 272 is displaced vertically by the lift spring 270. When the lifter 272 has reach its maximum height, the stop tail 294 catches on the stop wall 334 of the lifter stop 124 such that the lifter 272 is prevented from sliding out of the gap 300.

It is preferable that the lifter 272 may be comprised of five sets of stop apertures 296. One for the relaxed position, and four more for each bullet shot. The pegs 374 of the lift anchor 128 are inserted through the first set of stop apertures 296A when the handgun 10 is in its relaxed position before it has been fired. While the trigger handle 20 is being displaced for the first shot, the lifter 272 is displaced vertically causing the pegs 374 to be pressed into the anchor base 356 and then when the second set of apertures 296B is in line with the pegs 374, the pegs 374 are inserted in the second set of apertures 296B by the relaxation of the anchor spring 358 and thus anchor the lifter 272 in place. This process repeats for the second shot where the pegs 374 are then inserted into the third set of apertures 296C, the third shot where the pegs 374 are inserted into the fourth set of apertures 296D, and the fourth shot where the pegs are inserted into the fifth set of apertures 296E.

It is preferable that the lifter 272 may be comprised of three spring apertures 298. The top of the first spring aperture 298A is approximately disposed in line with the third set of apertures 296C, the top of the second spring aperture 298B is approximately in line with the fourth set of apertures 296D, and the top of the third spring aperture 298C is approximately in line with the fifth set of apertures 296E. When the trigger handle 20 is displaced for the first shot, the arm 306 of the lift spring 270 inserts into the first spring aperture 298A and lifts upward, catching the top of the aperture 298A and consequently displaces the lifter 272 vertically. When the second shot is fired, arm 306 of the lift spring 270 inserts into the second spring aperture 298B and similarly displaces the lifter 272 vertically. When the third shot is fired, the arm 306 of the lift spring 270 inserts into the third spring aperture 298C and similarly displaces the lifter 272 vertically. When the fourth shot is fired, the arm 306 of the lift spring 270 inserts under the front wall 292 of the lifter 272 and displaces the lifter 272 vertically by pushing against the bottom of the front wall 292.

One skilled in the art would recognize that fewer sets of stop apertures 296 and fewer spring apertures 298 may be used if the magazine 28 was designed for fewer bullets. Conversely, one skilled in the art would also recognize that more sets of stop apertures 296 and spring apertures 298 may be used if the magazine 28 was designed for more bullets.

The sets of stop apertures 296 and the spring apertures 298 are disposed in the front wall of the lifter 272 and spaced apart such that the lifter displaces the magazine 28 perfectly on each shot such that the bullet chambers 80 of the magazine 28 are perfectly aligned with the bore 64 for each shot. For example, when the handgun 10 is completely loaded and in the relaxed position before any shots have been fired, the head 150 of the hammer 32 rests on top of the magazine 28. When the first shot is fired, the pegs 374 of the lift anchor 128 are displaced from the first set of stop apertures 296A and inserted Into the second set of stop apertures 296B. Meanwhile, the hammer 32 has cocked back and snapped forward to fire the first bullet. After the first bullet is fired, the head 150 hammer 32 rests in the first bullet chamber 80A. After the second shot, the pegs 374 of the lift anchor 128 are displaced from the second set of stop apertures 296B and inserted into the third set of stop apertures 296C. Meanwhile, the hammer 32 has cocked back and snapped forward to fire the second bullet. After the second bullet is fired, the head 150 of the hammer 32 now rests in the second bullet chamber 80B. This process repeats with the hammer resting in the third and fourth bullet chambers 80C and 80D upon firing of the third and fourth bullets.

In order to align the preferred magazine 28, described above, with the bore 64, it is preferable that the centers of the first set of stop apertures 296A are about five millimeters from the top of the front wall 292. The centers of the second set of stop apertures 296B are preferably about nine millimeters from the top of the front wall 292. The centers of the third set of stop apertures 296C are preferably about seventeen millimeters from the top of the front wall 292. The centers of the fourth set of stop apertures 296D are preferably about twenty-five millimeters from the top of the front wall 292. The centers of the fifth set of stop apertures 296E are preferably about thirty-three millimeters from the top of the front wall 292. The top of the first spring aperture 298A is preferably about sixteen millimeters from the top of the front wall 292. The top of the second spring aperture 298B is preferably about twenty-four millimeters from the top of the front wall 292. Finally, the top of the third spring aperture 298C is preferably about thirty-two millimeters from the top of the front wall 292.

Figure 61:
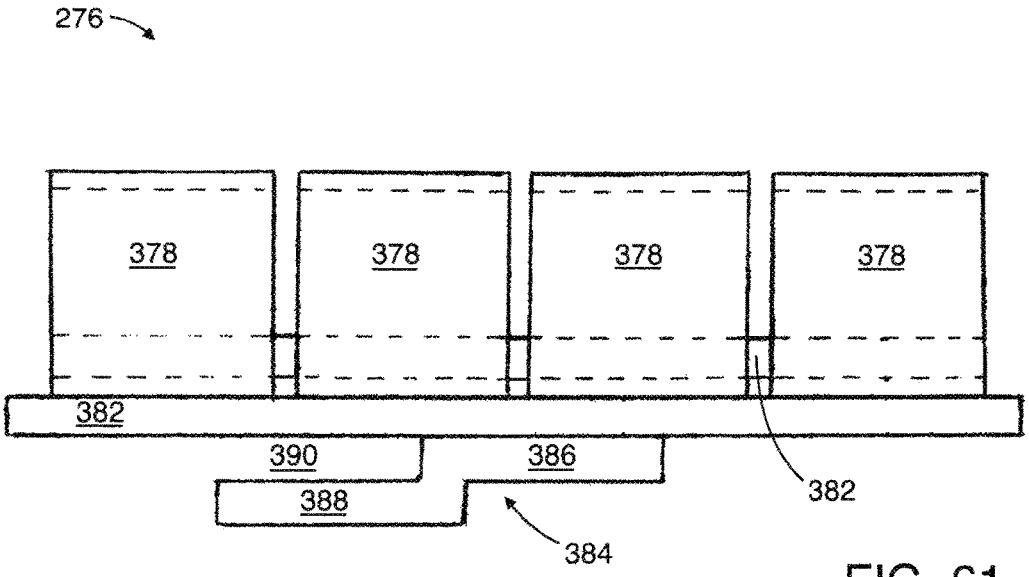
FIG. 61 illustrates a side plan view of a magazine clip of the handgun of FIGS. 1 and 2.
Figure 62:
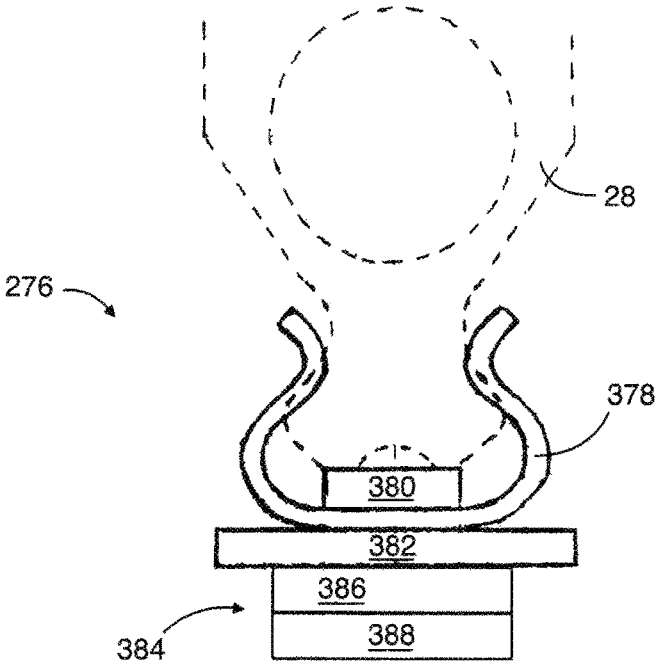
FIG. 62 illustrates a front plan view of the magazine clip of FIG. 61 with a dashed outline of the magazine of FIGS. 10 and 11 clipped in place.

FIGS. 61 and 62 illustrate a side and a front plan view respectively of the magazine clip 276. The magazine clip 276 is comprised of one or more U-clips 378, a spacer 380, a base 382, and a lifter connect 384. The base 382 is a flat bar, and the one or more U-clips 378 are attached to the base 382 by weld, screw, or by any other method known in the art. Preferably there are four U-clips 378 attached to a top face of the base 382. A spacer 380 is also a flat bar, with a smaller width than the width of the base 382 such that the spacer 380 may fit inside the U-clips 378. The spacer is attached to the inside of the U-clips by weld, screw, or by any other method known in the art. A lifter connect 384 is attached to the center of a bottom face of the base 382. The lifter connect 384 is comprised of a foundation 386 which attaches to the base 382, and an overhang 388 which creates a slot 390 between the overhang 388 and the base 382. The front wall 292 of the lifter 272 inserts into the slot 390 such that the lifter 272 is secured to the magazine lift 276.

The magazine 28 clips into the magazine clip 276 and is vertically displaced when the lifter 272 vertically displaces the magazine clip 276. The magazine 28 clips into the magazine clip 276 by inserting the clip body 88 of the magazine 28 into the U-clips 378. When the clip body 88 is inserted into the U-clips 378 the U-clips 378 flex open and then flex closed, secured in the waist 86 of the magazine 28. The clip body 88 is rests on the spacer 380 when the magazine 28 is clipped in the magazine clip 276. The spacer 380 ensures that the U-clips 378 are pinching the waist 86 of the magazine 28 and exerting pressure on the clip body 88 so as to secure the magazine 28 in the magazine clip 276.

Although one preferred embodiment has been described in detail for purposes of illustration, various modifications may be made without departing from the scope and spirit of the invention. For example, each mechanism, including the firing mechanism 12, the trigger force mechanism 14, and the magazine lift mechanism 16 may be comprised of components other than springs. For example, the mechanisms 12, 14, and 16 may be comprised of gears or some other components that accomplish the same functionality described above. Accordingly, the invention is not to be limited, except as by the appended claims.

What is claimed is:

1. A handgun, comprising:

a body having an interior and an exterior;

a barrel having a magazine slot and a muzzle, wherein the barrel is disposed superiorly to the body, wherein the magazine slot defines an opening which leads to the interior of the body; and a magazine, wherein the magazine is disposed partially within the magazine slot and partially within the interior of the body.

2. The handgun of claim 1, wherein the magazine is comprised of a first bullet chamber, a second bullet chamber, a third bullet chamber, and a fourth bullet chamber, wherein each bullet chamber is loaded with a bullet.

3. The handgun of claim 2, further comprising a trigger handle having an interior and an exterior wherein the body is disposed partially within the interior of the trigger handle and wherein the trigger handle is displaced from a first position to a second position in order to fire the handgun.

4. The handgun of claim 3, further comprising a trigger mechanism comprised of a hammer and a hammer spring having a first end and a second end, wherein the first end of the hammer spring is attached to the barrel and the second end is attached to the hammer, wherein the hammer spring is stretched and the hammer is cocked backwards when the trigger handle is displaced from the first position to the second position, and wherein the hammer spring relaxes and the hammer snaps forward when the trigger handle reaches the second position.

5. The handgun of claim 4, further comprising a trigger force mechanism having an upper trigger handle spring and a lower trigger handle spring disposed within the trigger handle, wherein the upper trigger handle spring and the lower trigger handle spring are compressed when the trigger handle is displaced from the first position to the second position and wherein the upper trigger handle spring and the lower trigger handle spring relax to return the trigger handle to the first position after the trigger handle has been displaced to the second position.

6. The handgun of claim 5, wherein the one or more handle springs of the trigger force mechanism have an effective spring constant between about 12,500 newtons per meter and about 19,000 newtons per meter.

7. The handgun of claim 6, wherein the trigger force mechanism is further comprised of an upper rod, a lower rod, and a handle spring base, wherein the upper rod and the lower rod are attached orthogonally to a back wall of the trigger handle, wherein the handle spring base is disposed in the body and is comprised of an upper rod aperture and a lower rod aperture, and wherein the upper rod and the lower road extend through the upper rod aperture and the lower road aperture respectively, and slide through the upper rod aperture and the lower road aperture when the trigger handle is displaced so as to guide the displacement of the trigger handle in a linear path.

8. The handgun of claim 7, wherein the trigger handle further comprises a rivet and the body further comprises a trigger handle notch, such that the rivet of the trigger handle slides from a first position to a second position in the trigger handle notch when the trigger handle is displaced from the first position to the second position, so as to further guide the displacement of the trigger handle in a linear path.

9. The handgun of claim 8, further comprising a magazine lift mechanism comprised of a lift spring and a lifter, wherein the lift spring vertically displaces the lifter upon displacement of the trigger handle from the first position to the second position.

10. The handgun of claim 9, wherein the magazine lift mechanism further comprises a lift anchor, wherein the lift anchor secures the lifter in place after the lifter has been vertically displaced.

11. The handgun of claim 10, wherein the lift mechanism further comprises a magazine clip, wherein the magazine is removeably attached to the magazine clip and wherein the magazine clip is secured to the lifter such that when the lifter is vertically displaced the magazine clip and magazine are also vertically displaced.

12. The handgun of claim 11, wherein the vertical displacement of the magazine aligns the bullet chambers with the hammer such that when the trigger handle is first displaced, the magazine is vertically displaced such that the bullet in the first bullet chamber is aligned with and struck by the hammer of the firing mechanism, when the trigger handle is displaced a second time, the magazine is again vertically displaced such that the bullet in the second bullet chamber is aligned with and struck by the hammer of the firing mechanism, when the trigger handle is displaced a third time, the magazine is again vertically displaced such that the bullet in the third bullet chamber is aligned with and struck by the hammer of the firing mechanism, and when the trigger handle is displaced a fourth time, the magazine is again vertically displaced such that the bullet in the fourth bullet chamber is aligned with and struck by the hammer of the firing mechanism.

13. The handgun of claim 12, wherein the lift mechanism further comprises a lift spring guide and a lifter stop, wherein the lift spring guide is comprised of a spring notch, wherein the spring notch guides the lift spring in a vertical path as it vertically displaces the lifter and wherein the lifter stop prevents the lifter from falling out of the magazine slot once the lifter has been vertically displaced to a maximum height.

14. The handgun of claim 13, wherein the lift mechanism further comprises a lift reset spring, wherein the lift reset spring provides for a smooth transition of the lift spring back to a starting position.

15. The handgun of claim 14, further comprising a poker, wherein the poker is removeably attached to the interior of the body and wherein the poker may be used to remove bullet casings from the bullet chambers of the magazine after the handgun has been fired.

16. A handgun, comprising:

a body having an interior and an exterior;

a trigger handle having an interior and an exterior wherein the body is disposed partially within the interior of the trigger handle and wherein the trigger handle is displaced from a first position to a second position in order to fire the handgun;

a barrel having a magazine slot and a muzzle, wherein the barrel is disposed superiorly to the body and the trigger handle and wherein the magazine slot defines an opening which leads to the interior of the body;

a magazine, wherein the magazine is disposed partially within the magazine slot and partially within the interior of the body; and a magazine lift mechanism disposed within the body, wherein the magazine lift mechanism vertically displaces the magazine through the magazine slot when the trigger handle is displaced from the first position to the second position.

17. The handgun of claim 16, wherein the magazine further comprises a first bullet chamber, a second bullet chamber, a third bullet chamber, and a fourth bullet chamber.

* * * * *